US012584642B2

(12) United States Patent
Schreiber

(10) Patent No.: US 12,584,642 B2
(45) Date of Patent: Mar. 24, 2026

(54) CENTRAL MEDICAL SUITE SYSTEM

(71) Applicant: SLD Technology, Inc., Portland, OR (US)

(72) Inventor: Kevin Joseph Schreiber, Portland, OR (US)

(73) Assignee: SLD Technology, Inc., Portland, OR (US)

( * ) Notice: Subject to any disclaimer, the term of this patent is extended or adjusted under 35 U.S.C. 154(b) by 595 days.

(21) Appl. No.: 17/749,043

(22) Filed: May 19, 2022

(65) Prior Publication Data

US 2024/0133564 A1 Apr. 25, 2024
US 2024/0230117 A9 Jul. 11, 2024

Related U.S. Application Data

(60) Provisional application No. 63/190,241, filed on May 19, 2021.

(51) Int. Cl.

| | |
|---|---|
| ***F24F 7/003*** | (2021.01) |
| ***F24F 8/20*** | (2021.01) |
| ***F24F 11/00*** | (2018.01) |
| ***F24F 11/50*** | (2018.01) |
| ***F24F 11/63*** | (2018.01) |
| ***F24F 11/72*** | (2018.01) |
| *F24F 110/10* | (2018.01) |

(Continued)

(52) U.S. Cl.
CPC ..... *F24F 7/003* (2021.01); *F24F 8/20* (2021.01); *F24F 11/63* (2018.01); *F24F 2110/10* (2018.01); *F24F 2110/20* (2018.01); *F24F 2110/50* (2018.01); *F24F 2221/36* (2013.01)

(58) Field of Classification Search
CPC ..... F24F 8/20; F24F 7/003
See application file for complete search history.

(56) References Cited

U.S. PATENT DOCUMENTS 3,966,407 A * 6/1976 Zuckerberg ..... F24F 8/20 422/4
2013/0246088 A1* 9/2013 Huster ..... G06Q 10/0635 705/2

(Continued)

FOREIGN PATENT DOCUMENTS

KR 20090098514 A * 9/2009
KR 101381209 B1 * 4/2014

OTHER PUBLICATIONS

KR101381209 and translation (Year: 2014).*
KR20090098514 and translation (Year: 2009).*

*Primary Examiner* — Steven S Anderson, II
(74) *Attorney, Agent, or Firm* — Evan R. Sotiriou; Burris Law, PLLC

(57) ABSTRACT

A central medical suite system includes a modular air handling device configured to distribute airflow throughout the central medical suite system and at least one of: a modular air return device, a modular patient lift system, a lighting and air distributing unit, a room perimeter disinfecting system. The central medical suite system further includes an electronic control module configured to control the airflow from the modular air handling device and control one or more environmental remediation devices provided on at least one of the modular air handling device, the modular air return device, the modular patient lift system, the lighting and air distributing unit, and the room perimeter disinfecting system.

10 Claims, 16 Drawing Sheets

(51) Int. Cl.
*F24F 110/20* (2018.01)
*F24F 110/50* (2018.01)

(56) References Cited

U.S. PATENT DOCUMENTS

| | | | | |
|---|---|---|---|---|
| 2014/0140887 | A1* | 5/2014 | Parham | F24F 8/10 422/4 |
| 2017/0296378 | A1* | 10/2017 | Schaefer | G05B 15/02 |
| 2018/0106491 | A1* | 4/2018 | Abrishamkar | F24F 1/68 |
| 2018/0283723 | A1* | 10/2018 | Ock | G05B 15/02 |
| 2020/0085657 | A1* | 3/2020 | Wiggermann | B66C 13/16 |
| 2020/0231128 | A1* | 7/2020 | Bailey | B60S 3/008 |

* cited by examiner

CENTRAL MEDICAL SUITE SYSTEM

CROSS-REFERENCE TO RELATED APPLICATIONS

This non-provisional application claims the benefit of and priority to U.S. Provisional Application No. 63/190,241, filed May 19, 2021. The disclosure of the prior application is hereby incorporated by reference herein in its entirety.

BACKGROUND

Current medical settings or spaces, such as surgical suites and imaging rooms, utilize many different types of equipment, such as lighting, sanitation, patient lifts, heating, ventilation, and air conditioning (HVAC) systems, electronic controls, and so forth. The equipment is conventionally standalone, meaning that lighting equipment is provided separately from sanitation equipment, which is in turn provided separately from the HVAC system, and so forth. Because the equipment is conventionally standalone, costly and time intensive modifications or repairs can be necessary to ensure the equipment is compatible with all the other pieces of equipment used. These modifications are inefficient and, in some cases, can have adverse effects if performed incorrectly.

SUMMARY

This Summary is provided to introduce a selection of concepts in a simplified form that are further described below in the Detailed Description. This Summary is not intended to identify key factors or essential features of the claimed subject matter, nor is it intended to be used to limit the scope of the claimed subject matter.

In various examples, a central medical suite system comprises a modular air handling device configured to distribute airflow throughout the central medical suite system and at least one of: a modular air return device, a modular patient lift system, a lighting and air distributing unit, a room perimeter disinfecting system. The central medical suite system further comprises an electronic control module configured to control the airflow from the modular air handling device and control one or more environmental remediation devices provided on at least one of the modular air handling device, the modular air return device, the modular patient lift system, the lighting and air distributing unit, and the room perimeter disinfecting system.

In various examples, a controller for a medical room comprises a user interface configured to receive a user input, a display, and an electronic control module. The electronic control module is configured to control airflow from a modular air handling device and control one or more environmental remediation devices provided on at least one of an modular air handling device, a modular air return device, a modular patient lift system, a lighting and air distributing unit, and a room perimeter disinfecting system, wherein the modular air handling device is configured to distribute airflow throughout the medical room.

In various examples, a method for controlling air quality in a medical room comprises receiving data from one or more sensors provided on at least one of a modular air handling device, a modular air return device, a modular patient lift system, a lighting and air distributing unit, and a room perimeter disinfecting system. The method further comprises analyzing the received data and controlling one or more environmental remediation devices based on the analyzed data to change an environmental condition within the medical room.

To the accomplishment of the foregoing and related ends, the following description and annexed drawings set forth certain illustrative aspects and implementations. These are indicative of but a few of the various ways in which one or more aspects may be employed. Other aspects, advantages and novel features of the disclosure will become apparent from the following detailed description when considered in conjunction with the annexed drawings.

BRIEF DESCRIPTION OF THE DRAWINGS

The examples disclosed herein may take physical form in certain parts and arrangement of parts, and will be described in detail in this specification and illustrated in the accompanying drawings which form a part hereof and wherein.

DETAILED DESCRIPTION

Figure 1:
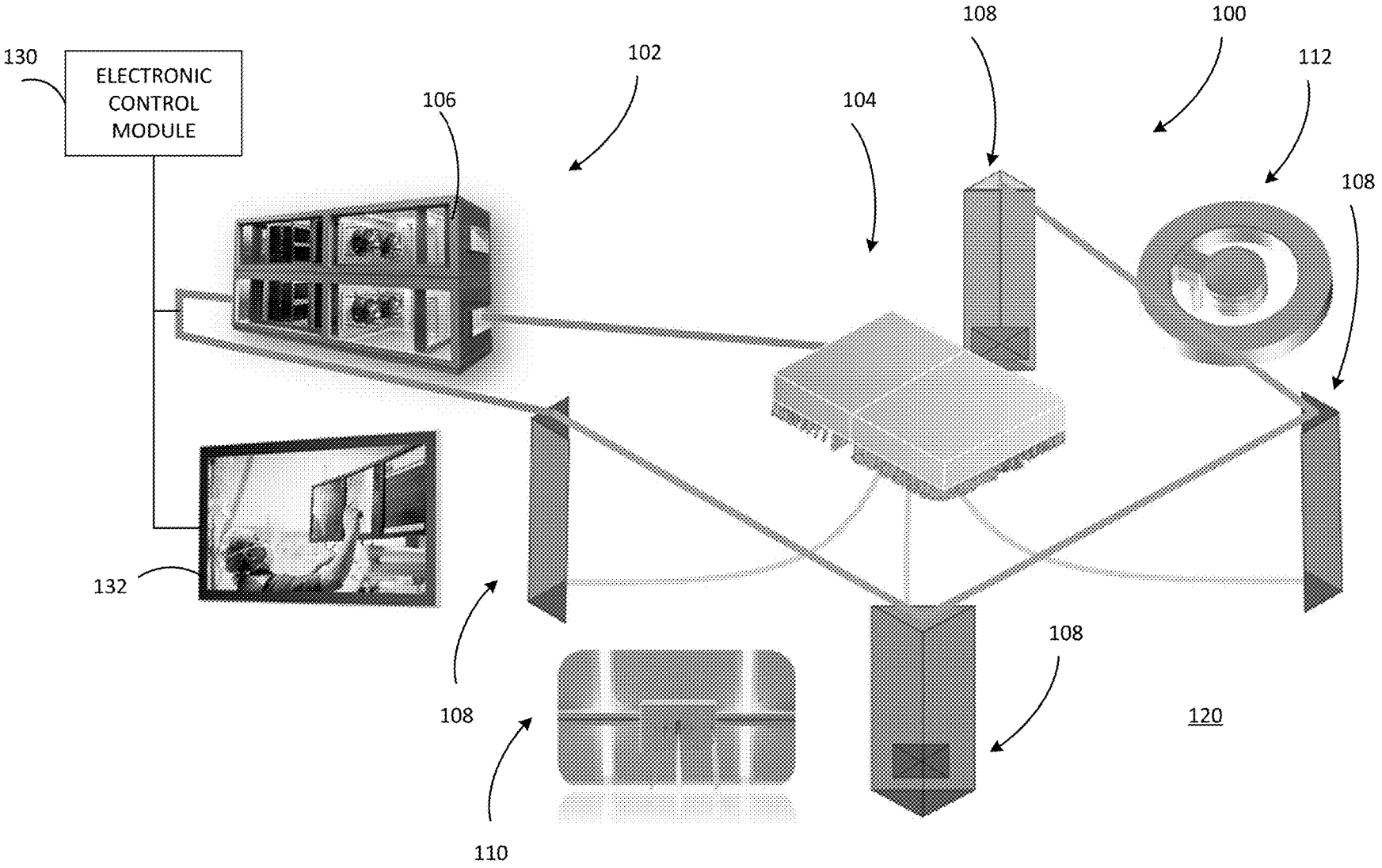
FIG. 1 is a diagram illustrating a central medical suite system according to various examples.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It may be evident, however, that the claimed subject matter may be practiced without these specific details. In other instances, structures and devices are shown in block diagram form in order to facilitate describing the claimed subject matter.

Various examples of the present disclosure provide a medical suite system that includes and connects major apparatuses used in a medical setting, such as in a surgical suite or imaging room, for at least comprehensive monitoring, analysis, and adjustment of conditions of the environment. The medical suite system disclosed herein is configured as a "smart" suite that in one or more examples enables environmental feedback and a closed contamination control loop (or closed loop contamination control) by collecting environmental feedback from multiple sources of connected equipment in different areas of the medical suite, monitoring and analyzing the feedback at a central source, and controlling adjustments to affect changes in the environmental conditions from the central source.

As described herein, various examples of the present disclosure provide a central environmental control system, or medical suite system, that includes an electronic control module, and one or more of an HVAC system, a modular return air device, a modular patient lift system, a lighting system, and a room perimeter disinfecting system. In one example, each of the elements of the central environmental control system individually includes at least one of environmental sensors and environmental remediation devices (e.g., disinfecting units) in order to monitor environmental conditions at specific locations throughout the suite and, if necessary, adjust one or more settings or operations to affect the environmental conditions at the specific location based on the collected environmental data. The individual environmental sensors and environmental remediation devices are provided in addition to a room perimeter disinfecting system that continually disinfects the perimeter of the room in one example. The environmental conditions can be monitored and automatically adjusted or be adjusted via the electronic control module, which in one example include independent control of each of the components. Accordingly, various examples and implementations of the present disclosure enable improved airflow and environmental conditions throughout the medical suite by automatic monitoring and, when necessary, adjustment to affect change to one or more environmental conditions to return to preset thresholds (e.g., above a defined air quality level).

FIG. 1 illustrates an example central medical suite system 100 according to various examples of the present disclosure. The central medical suite system 100 illustrated in FIG. 1 is for illustration only and should not be construed as limiting. Various examples of the central medical suite system 100 can be used without departing from the scope of the present disclosure.

As illustrated in FIG. 1, the central medical suite system 100 includes an HVAC system 102 interconnected to a lighting and an air distributing unit 104 that distributes air throughout the medical suite 120. In some examples, the HVAC system 102 includes a modular air handling device 106 that eliminates cross-contamination between separate rooms and builds in redundancy via an air-redirection device. In particular, the modular air handling device 106 includes multiple independent air tunnels and an air redirection device that are all modularly connected within the air handling device, such as described in co-pending application Ser. No. 17/529,010, entitled "Air Handling Device." The modular arrangement including the air redirection device allows air to be redirected from any individual air tunnels to any other individual air tunnel by opening and closing dampers between the air tunnels and the air redirection device, and within the air redirection device itself. The air flows from the modular air handling device 106 to the lighting and air distributing unit 104, which disperses the air through the medical suite 120. The lighting and air distributing unit 104 in some examples is an airflow channeling surgical light system that also enables airflow, while providing lighting systems applicable across numerous medical settings, such as described in U.S. Pat. Nos. 9,895,202, 9,903,115, 10,405,942, 11,186,989, and 11,259,893. In one example, the lighting and air distributing unit 104 can include a zonal pressure control (ZPC) system, such as described in co-pending U.S. application Ser. No. 17/694,377, entitled "Zonal Pressure Control (ZPC) in Imaging Rooms," that includes a plurality of vents to provide additional or controlled (e.g., directionally controlled) airflow through a gantry surface using a damper with hinged access to the vents, and diffuser covers for the vents. The damper controls the flow of air through the plurality of vents based on its position being open, partially open, or closed, in some examples. The ZPC further includes a plurality of vents provided in an imaging head that is supported by the gantry in order to allow airflow to further pass through the imaging head in some examples. The modular air handling device 106 and the lighting and air distributing unit 104 are also each described in greater detail below.

The central medical suite system 100 in some examples further includes one or more modular return air devices 108 that facilitate the return of dispersed air to the modular air handling device 106. The modular return air device includes a first air return configured to allow air to flow from the medical suite into the return and a second air return configured to allow air to flow from the return to the modular air handling device. In other words, the first air return is configured to facilitate airflow into the modular return air device and the second air return is configured to facilitate airflow out of the modular return air device. The modular return air device can be provided, for example, as described in co-pending application Ser. No. 17/748,570, entitled "Modular Return Air Device", and in greater detail below.

The central medical suite further 100 includes an electronic control module 130 that monitors, analyzes, and adjusts environmental conditions throughout the central medical suite system 100 (e.g., generates one or more control signals), and allows user interaction, such as via a user interface 132. The electronic control module 130 is described in greater detail below.

The central medical suite system 100 further includes a modular patient lift system 110 in some examples that transports a patient from outside the central medical suite system 100 to a specific location within the central medical suite system 100. The modular patient lift system 110 can be provided, for example, as described in co-pending application Ser. No. 17/747,223, entitled "Modular Patient Lift System", and in greater detail below.

Figure 2:
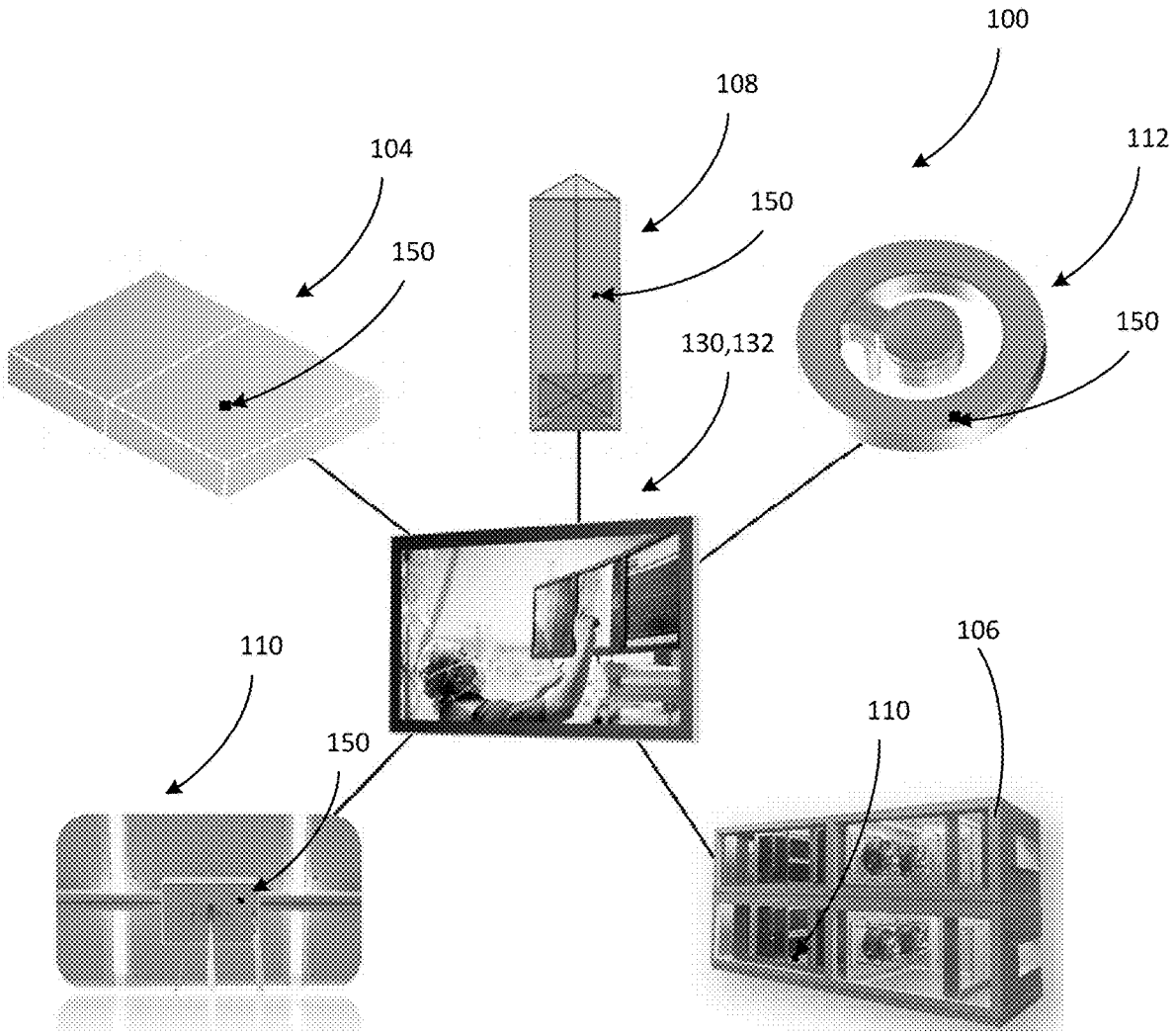
FIG. 2 is another diagram illustrating a central medical suite system according to various examples.

FIG. 2 illustrates a block diagram of the central medical suite system 100 according to various examples of the present disclosure. The central medical suite system 100 illustrated in FIG. 2 is for illustration only and should not be construed as limiting. Various examples of the central medical suite system 100 can be used without departing from the scope of the present disclosure.

As shown in FIG. 2, the electronic control module 130 is connected to each of the modular air handling device 106, the modular return air device 108, the lighting and air distributing unit 104, the modular patient lift system 110, and additional lighting units 112 in the illustrated example. The electronic control module 130 can be connected to each of the modular air handling device 106, the modular return air device 108, the lighting and air distributing unit 104, the modular patient lift system 110, and additional lighting units 112 via a wired connection or a wireless connection. The wireless connection can be a WiFi™ connection, a Bluetooth™ connection, and so forth. In some examples, each of the modular air handling device 106, the modular return air device 108, the lighting and air distributing unit 104, the modular patient lift system 110, and additional lighting units 112 include one or more sensors 150 that collect information, such as environmental feedback data, that is transmitted to and received by the electronic control module 130. The electronic control module 130 analyzes the received information to determine whether the environmental conditions at each particular location throughout the medical suite 120 are within threshold ranges that are optimal, acceptable, in need of adjustment, and so forth. Based on the results of the analysis, the electronic control module 130 is controlled (or control one or more components) to make necessary adjustments to the environmental conditions at the specific locations in need of adjustment or automatically makes the adjustments.

Figure 3:
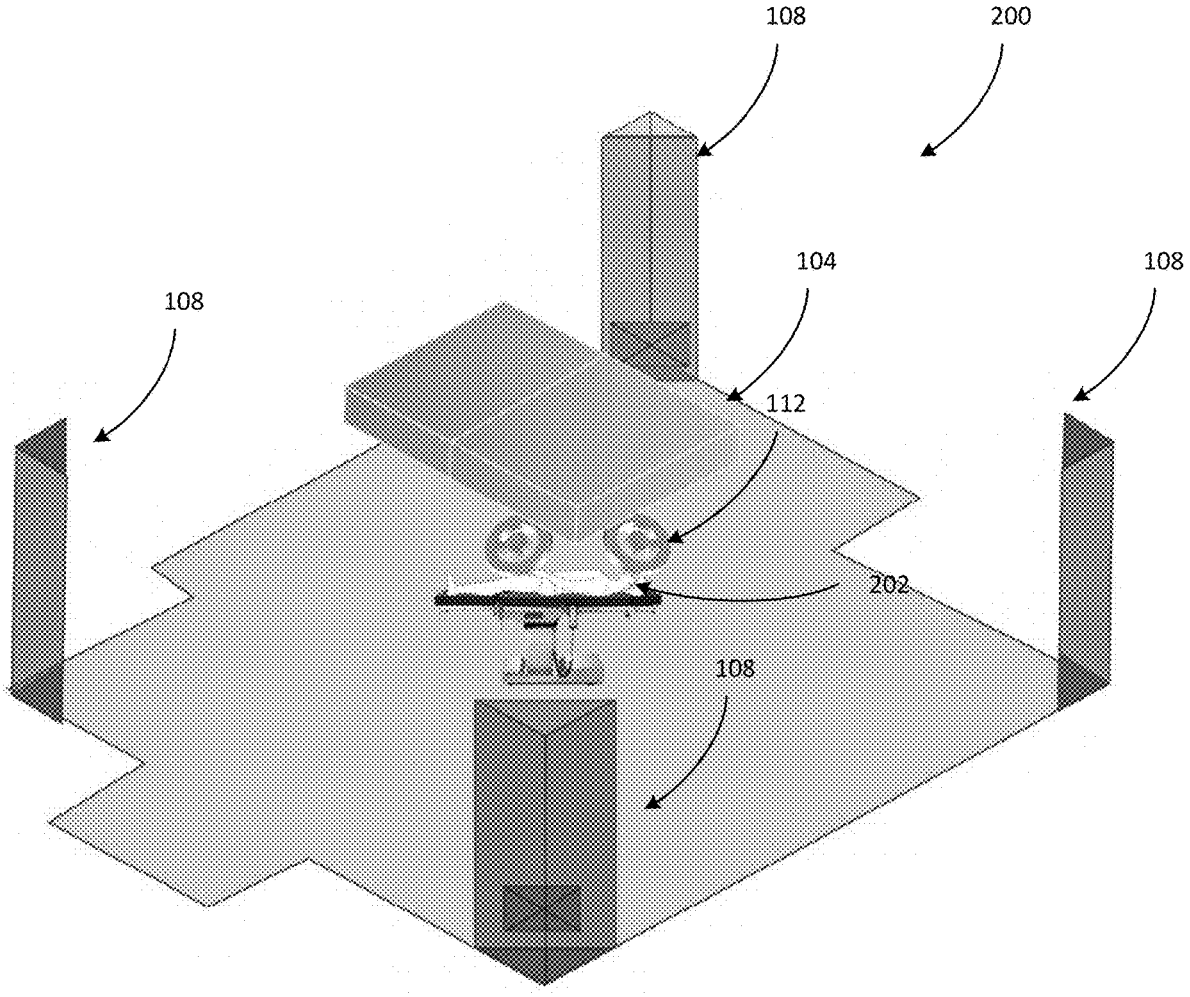
FIG. 3 is another diagram illustrating a central medical suite system according to various examples.

FIG. 3 illustrates an example central medical suite system 200 according to various examples of the present disclosure. The central medical suite system 200 illustrated in FIG. 3 is for illustration only and should not be construed as limiting. Various examples of the central medical suite system 200 can be used without departing from the scope of the present disclosure.

The central medical suite system 200 shown in FIG. 3 illustrates a patient 202 in addition to the modular return air device 108, the lighting and air distributing unit 104, and the additional lighting units 112. Accordingly, FIG. 3 illustrates an implementation of the central medical suite system 200 according to examples of the present disclosure.

Figure 4:
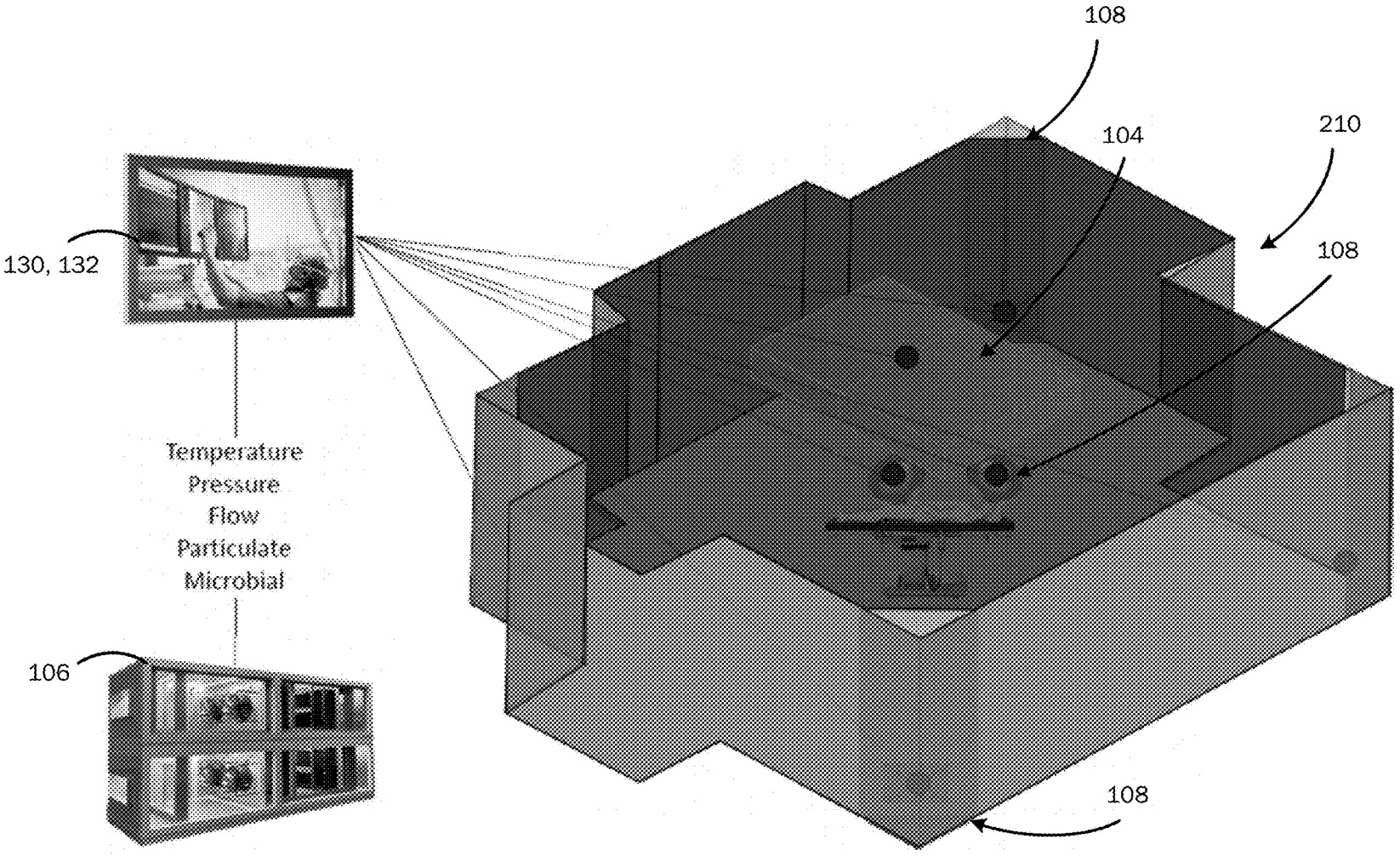
FIG. 4 is another diagram illustrating a central medical suite system according to various examples.

FIG. 4 illustrates an example central medical suite system 210 according to various examples of the present disclosure. The central medical suite system 210 illustrated in FIG. 4 is for illustration only and should not be construed as limiting. Various examples of the central medical suite system 210 can be used without departing from the scope of the present disclosure.

In particular, FIG. 4 illustrates a relationship between the electronic control module 130, the modular air handling device 106, the modular return air device 108, the lighting and air distributing unit 104, and the additional lighting units 112, and which can include a room perimeter disinfecting system. In some examples, the modular air handling device 106 includes control elements that allow for variable control of characteristics of the outgoing air such as the air temperature, the air pressure, the rate of airflow, the volume of airflow, particulate count and size in the air, microbial count and size in the air, and so forth based on the sensor data received from sensors 150 on one or more of the components. In some examples, the electronic control module 130 analyzes the data collected from outgoing air from the modular air handling device 106 in combination with the collected data from the sensors 150 on one or more of the modular return air device 108, the lighting and air distributing unit 104, and the additional lighting units 112, and the room perimeter disinfecting system in order to more accurately adjust the air characteristics. That is, a centrally coordinated control arrangement is thereby provided.

Figure 5:
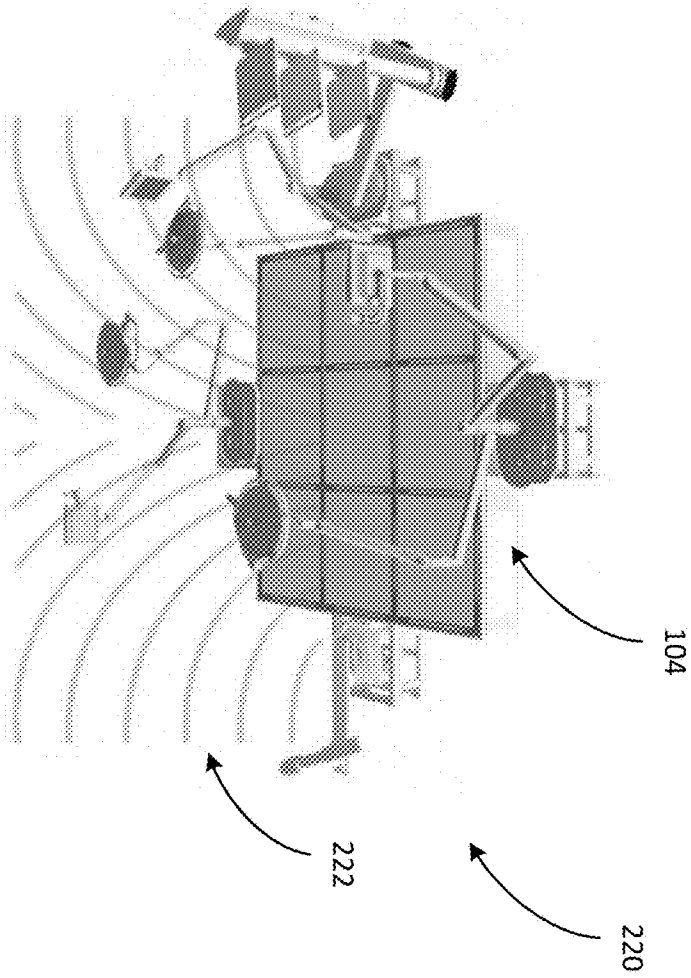
FIG. 5 is another diagram illustrating a central medical suite system according to various examples.

FIG. 5 illustrates an example central medical suite system 220 according to various examples of the present disclosure. The central medical suite system 220 illustrated in FIG. 5 is for illustration only and should not be construed as limiting. Various examples of the central medical suite system 220 can be used without departing from the scope of the present disclosure.

In particular, FIG. 5 illustrates the outflow of air 222 from the lighting and air distributing unit 104. In some examples, the outflow of the air 222 from the lighting and air distributing unit 104 is controlled by the electronic control module 130 based on the received sensor data from one or more of the modular return air device 108, the modular patient lift system 110, the lighting system, and the room perimeter disinfecting system.

Figure 6:
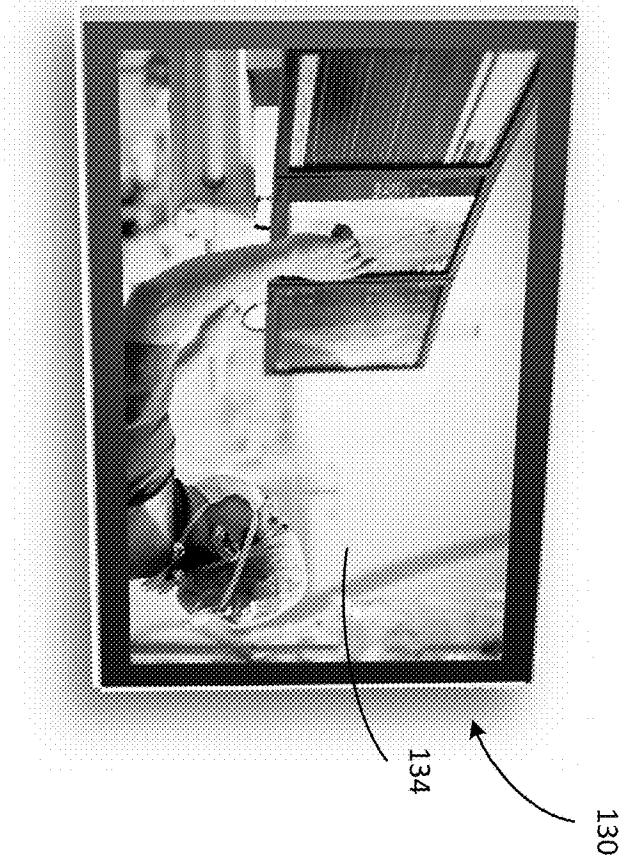
FIG. 6 is a diagram of a display according to various examples.

FIG. 6 illustrates the user interface 132 of the electronic control module 130 according to various examples of the present disclosure. The electronic control module 130 illustrated in FIG. 5 is for illustration only and should not be construed as limiting. Various examples of the electronic control module 130 can be used without departing from the scope of the present disclosure.

The electronic control module 130 can be a computing device as described herein. The electronic control module 130 includes a processor that monitors received data, analyzes the received data, and adjusts outgoing airflow based on the analysis of the received data in various examples. In some examples, the electronic control module 130 further controls disinfecting units, such as the room perimeter disinfecting system and/or the disinfecting units in various components of the central medical suite system 100, 200, 210, 220, to perform disinfecting operations) and other operations) of incoming and/or outgoing airflow.

In some examples, the electronic control module 130 includes as the user interface 132 a display 134, to display the received data. In one example, the electronic control module 130 can display the raw received data received from the one or more sensors 150. In another example, the electronic control module 130 can display a visualization or representation of the received data, including but not limited to charts, graphs, pie charts, and so forth. In these examples, the visualization is presented to more clearly indicate various thresholds for the received sensor data. Each characteristic of the airflow, such as temperature, humidity, etc., can have a preset threshold that includes desired ranges for the particular characteristic that are displayed on the display 134. For example, an optimal temperature for the central medical suite system 100, 200, 210, 220 can be 68° Fahrenheit. A temperature range from 67° to 69° can be considered to be "optimal", a temperature range from 65° to 67° and/or from 69° to 71° can be considered to be "acceptable", and a temperature range below 65° and/or above 71° can be considered to be "unacceptable". The display 134 displays either the raw received data, e.g., the measured temperature, of the central medical suite system 100, 200, 210, 220 as a whole or at a specific location, a visualization of the raw received data, such as a color corresponding to the particular range, or both in order to present the data to a user of the central medical suite system 100, 200, 210, 220. The display 134 can display data for specific locations within the central medical suite system 100, 200, 210, 220, data for zones within the central medical suite system 100, 200, 210, 220, or an overall temperature of the central medical suite system 100, 200, 210, 220, e.g., an average of all the received data at a particular time.

The electronic control module 130 further includes a memory that stores data. For example, the raw received data can be timestamped and stored in the memory. In some examples, the electronic control module 130 can display data received over time to monitor changes or fluctuations in particular sensor readings. For example, the electronic control module 130 can display a visualization, such as a line graph, that displays received sensor data over time. In some examples, the stored data can be accessed and viewed at a later time. As described herein, the sensor data can be received from one or more of the various components included in the central medical suite system 100, 200, 210, 220, including but not limited to the modular air handling device 106, the modular return air device 108, the lighting and air distributing unit 104, the modular patient lift system 110, and additional lighting units 112. In some examples, the one or more sensors 150 collect environmental data such as such as temperature of the air, humidity of the air, airflow volume, airflow speed, particulate counts in the air, the size of particulates in the air, microbial counts in the air, the size of microbials in the air, types of microbials in the air, and so forth. In some examples, the one or more sensors 150 are provided on a particular component to collect data specific to the particular component. For example, the modular patient lift system 110 includes sensors to collect data regarding the weight on the patient lift and g-forces of the patient lift.

In some examples, the electronic control module 130 receives an input from a user. The input can be received from a device operably connected to the electronic control module 130, such as a keyboard, a mouse, and so forth. In examples where the display 134 is a touchscreen or otherwise enabled to receive touch inputs, the input can be received directly on the display 134. In various examples, the input can select a particular aspect of data to present additional information, respond to a prompt, adjust one or more characteristics of air flowing into the central medical suite system 100, 200, 210, 220, and so forth. In some examples, the electronic control module 130 is voice activated and the input is a voice input. In some examples, the input is received from a remote computing device, such as a personal computer, laptop, smart phone, mobile tablet, hand-held device, consumer electronic, specialty computing device, and so forth.

Figure 7:
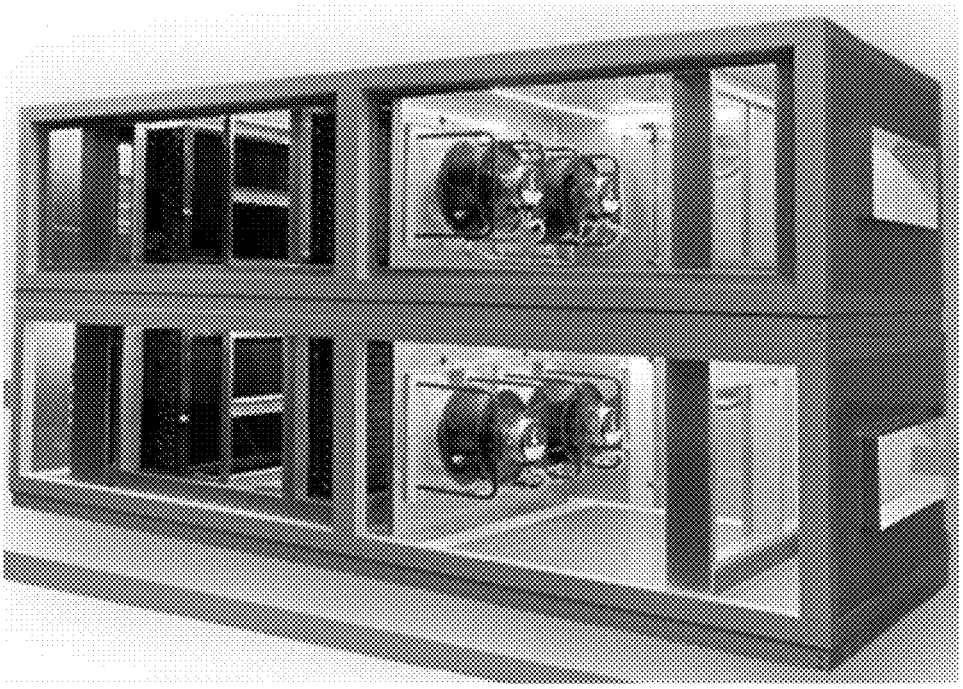
FIG. 7 is a diagram of a modular air handling device in connection with which various examples can be implemented.

FIG. 7 illustrates the modular air handling device 106 according to various examples of the present disclosure. The modular air handling device 106 illustrated in FIG. 7 is for illustration only and should not be construed as limiting. Various examples of the modular air handling device 106 can be used without departing from the scope of the present disclosure.

The modular air handling device 106 is an aspect of an improved HVAC system that reduces or eliminates the likelihood of infections from airborne particulates in a common supply and/or return duct and potentially increases the return on investment for a particular system in some examples. The modular air handling device 106 further reduces or eliminates the need for variable air volume (VAV) terminal devices and associated piping between the air handler and the central medicate suite in some examples. The modular air handling device 106 further lowers energy expenses due to reduced static in the system and increased controllability in some examples. Various examples of the modular air handling device 106 further provide instant feedback and adjustment due to direct connections to sensed environments and human created input requests for environmental changes in various examples. The modular air handling device 106 further provides smaller individual air tunnels with smaller individual components, requiring less time for maintenance and service, which further increases the return on investment for a user in various examples. The modular air handling device 106 further allows individual air tunnels to be transported through tighter and more efficient move-in paths and can be stacked or affixed in place at the point of installation of the unit in various examples. The modular air handling device 106 further enables humidification at an airflow point of entry to a distribution manifold in various examples.

In some examples, the modular air handling device 106 includes a plurality of tunnels. One of the tunnels is designated as redundant and on standby. In other words, one or more tunnels are not connected to a particular room, but act as a backup tunnel in the event of contamination or mechanical failure. For example, if a first operating room is found to be contaminated, the original tunnel can be closed off and the redundant tunnel can be enabled to continue service to the first operating room without contaminating the other operating rooms serviced by the air handling device. Each tunnel includes a damper placed in the connection between the tunnel and the respective unit of the first air select that can be opened or closed to control the flow of air out of the tunnel. Furthermore, the first air select includes a separate damper from each respective unit to the central unit. This arrangement allows the contaminated tunnel to be shut off via its damper to the tunnel and air to be routed from the redundant tunnel, through its respective unit, into the central unit, and to the ductwork so that clean air can continue to be supplied to the room without affecting the status of simultaneously used rooms. Accordingly, the modular air handling device 106 illustrated in FIG. 7 is capable of servicing multiple central surgical suites at a single time and controllable based feedback or other information received by the electronic control module.

In some examples, the modular air handling device 106 includes particulate sensing features and disinfecting devices within each tunnel, such as, but not limited to, ultraviolet (UV) light, UVC, Far-UVC, Near UV, 405 nm wavelength light, vaporized hydrogen peroxide (VHP), and so forth. If a reading on the sensor 150 exceeds a predetermined or variable threshold, a disinfectant mode can be triggered automatically, or an alarm can be set for manual activation via the electronic control module. Disinfection can take place in the sealed environment until a predetermined and acceptable elapsed time or particulate level is met. In some examples, the redundant tunnel is utilized as the disinfecting source and could provide the disinfecting method to any other tunnel that exceeds contamination thresholds that have been pre-determined.

Figure 8:
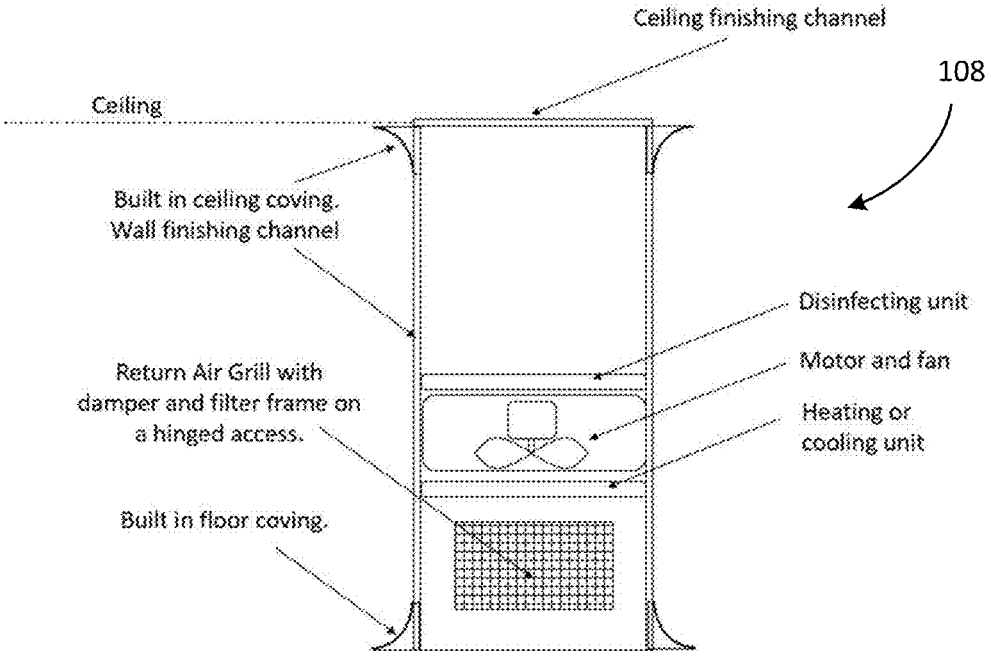
FIG. 8 is a diagram of a modular return air device in connection with which various examples can be implemented.
Figure 9:
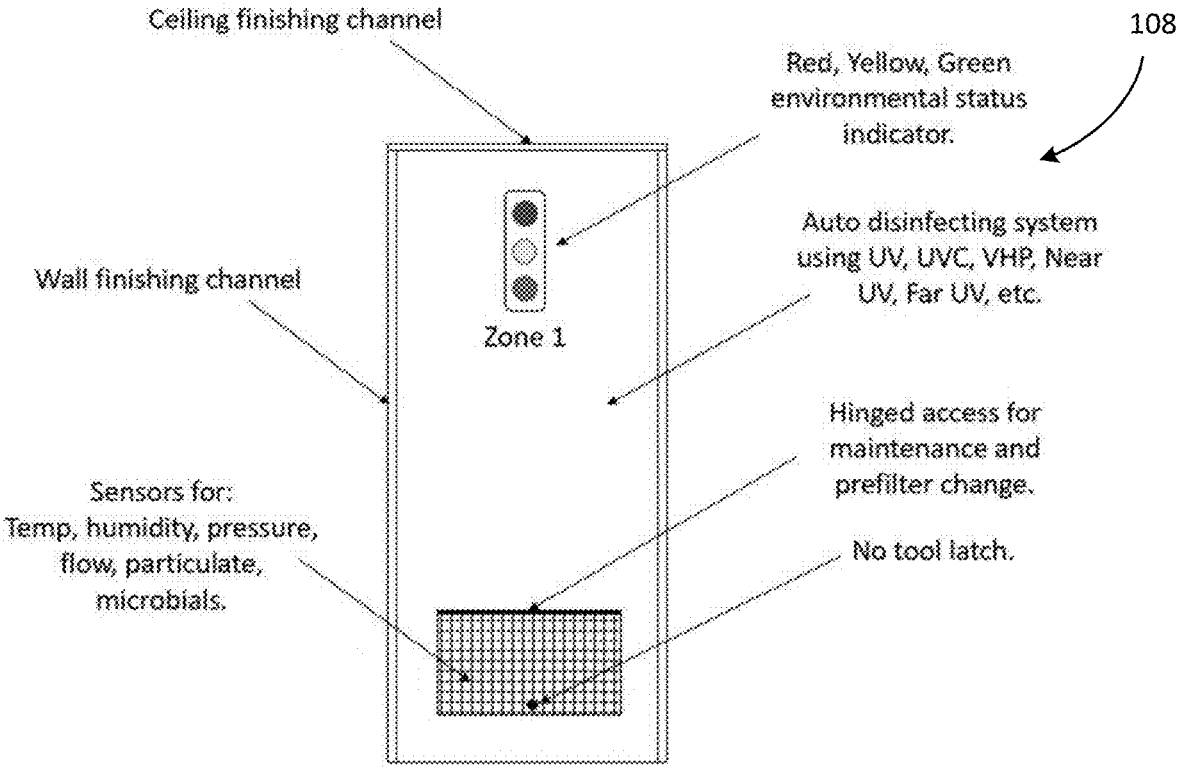
FIG. 9 is another diagram of a modular return air device in connection with which various examples can be implemented.

FIGS. 8 and 9 illustrate the modular return air device 108 according to various examples of the present disclosure. The modular return air device 108 illustrated in FIGS. 8 and 9 is for illustration only and should not be construed as limiting. Various examples of the modular return air device 108 can be used without departing from the scope of the present disclosure.

The modular return air device 108 enables improved airflow throughout the central surgical suite in various examples by providing specific feedback and analysis of air entering the modular return air device in order to further improve the air being introduced into the surgical suite.

The modular return air device 108 includes a first air return configured to allow air to flow from the central surgical suite into the return and a second air return configured to allow air to flow from the return to additional components of an HVAC system, such as the modular air handling device. In other words, the first air return is configured to facilitate airflow into the modular return air device and the second air return is configured to facilitate airflow out of the modular return air device 108. Air enters the modular return air device 108 through the return air grille. The return air grille includes one or more holes to facilitate the flow of air into the modular return air device from the central surgical suite. In some examples, the return air grille includes a damper, filter frame, and louver that is hinged to provide access from the space to install an air filter and adjust the amount of airflow to be allowed through the return air grille at any one time. In some examples, the damper is able to be manually adjusted, such as by a user, by mechanically adjusting the damper to allow more or less airflow into the modular return air device 108 through the return air grille. In some examples, the damper is able to be controlled via the electronic control module 130 accessed by a user. In some examples, the damper is automatically controlled by the electronic control module 130 based on feedback received throughout the central surgical suite system of which the modular return air device 108 is included. For example, the feedback can include feedback received from one or more sensors 150 on or in the modular return air device 108.

The modular return air device 108 further includes a temperature control unit to control the temperature of the air that flows through the modular return air device 108. The temperature control unit includes a heating element to heat air received in the modular return air device 108 and a cooling element to cool air received in the modular return air device 108. In examples where the air received in the modular return air device 108 is determined to be a temperature that is too low, the heating element can be activated in order to heat the air as the air passes through the modular return air device 108. Conversely, in examples where the air received in the modular return air device 108 is determined to be a temperature that is too high, the cooling element can be activated in order to cool the air as the air passes through the modular return air device 108. In various examples, the temperature control unit can be activated manually by a user, electronically by a user via the electronic control module 130, or automatically based on feedback received throughout the HVAC system, including but not limited to feedback received from one or more sensors 150 on or in the modular return air device 108.

The modular return air device 108 further includes a motor and fan to provide active airflow through the modular return air device 108. The fan is powered by the motor and controls the rate at which air is drawn into the modular return air device 108, through the first air return, and at which air is drawn out of the modular return air device 108 through the second air return. In various examples, the motor and fan can be activated manually by a user, electronically by a user via the electronic control module 130, or automatically based on feedback received throughout the central surgical suite system, including but not limited to feedback received from one or more sensors on or in the modular return air device 108.

The modular return air device 108 further includes a disinfecting unit to disinfect air flowing through the modular return air device 108. The disinfecting unit can include disinfecting elements to disinfect the air by using disinfecting technology including, but not limited to, ultraviolet (UV) light, UVC, Far-UVC, Near UV, 405 nm wavelength light, vaporized hydrogen peroxide (VHP), and so forth. The disinfecting unit may be integrated with (e.g., communicatively coupled) the one or more of the sensors 150, such as the sensors 150 that detect particulate levels, microbial levels, and so forth. In some examples, the one or more sensors 150 can detect levels of particulates and/or microbials present in the air entering the modular return air device 108. Based on the detected particulate and/or microbial levels, the disinfecting unit identifies the type of disinfecting elements to activate to disinfect the incoming air, an amount, e.g., volume, of disinfect to use to disinfect the incoming air, an amount of time to activate the identified disinfecting elements, and so forth to automatically disinfect the incoming air to the modular return air device 108.

In various examples, the disinfecting unit can be activated manually by a user, electronically by a user via the electronic control module 130, or automatically based on feedback received throughout the central surgical suite system, including but not limited to feedback received from one or more sensors 150 on or in the modular return air device 108.

As described herein, the modular return air device 108 includes the one or more sensors 150. The one or more sensors 150 can be provided on the exterior of or inside the modular return air device 108. The one or more sensors 150 collect and measure data regarding the air that flows into the modular return air device 108. For example, the one or more sensors 150 include, but are not limited to, sensors that measure one or more of temperature, humidity, pressure, rate of airflow, volume of airflow, particulate speed, particulate counts, microbial size, microbial counts, microbial types, and so forth of the air flowing through the modular return air device 108. In some examples, the data obtained from the one or more sensors 150 is used to control one or more of the damper on the return air grille, the temperature control unit, the motor and fan, and the disinfecting unit. In some examples, the data obtained from the one or more sensors 150 is displayed on the electronic control module 130 for viewing by a user. In these examples, the user can manually control or electronically control, via the electronic control module 130, one or more of the damper on the return air grille, the temperature control unit, the motor and fan, and the disinfecting unit based on the viewed data.

Figure 10:
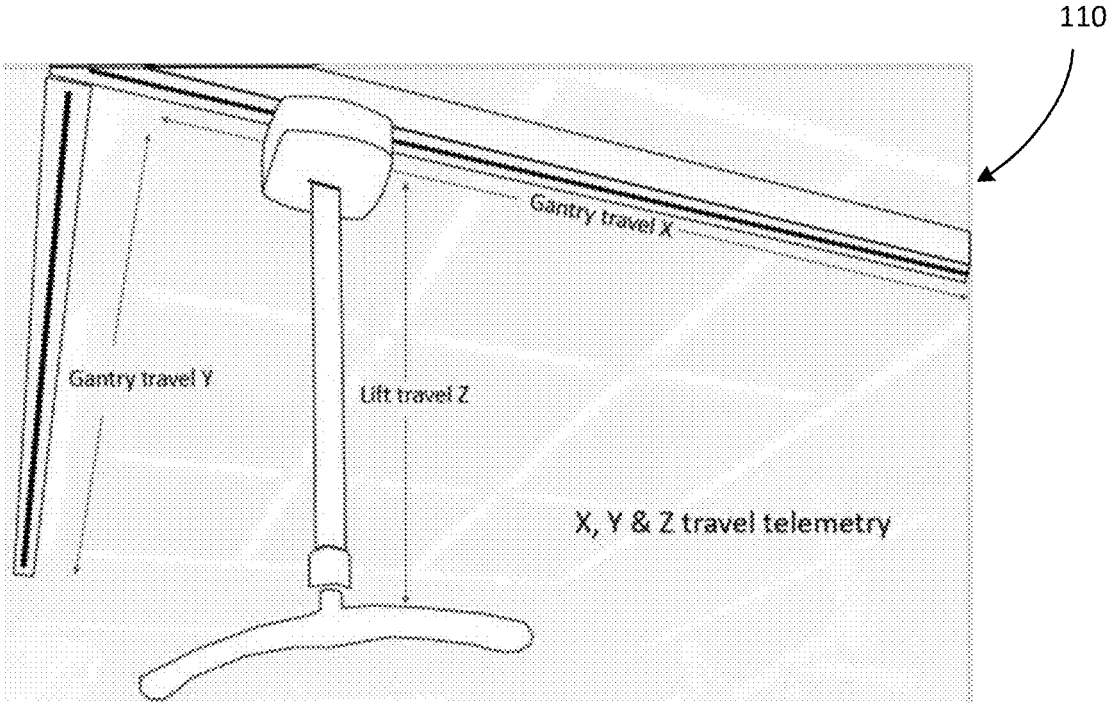
FIG. 10 is a diagram of a modular patient lift system in connection with which various examples can be implemented.
Figure 11:
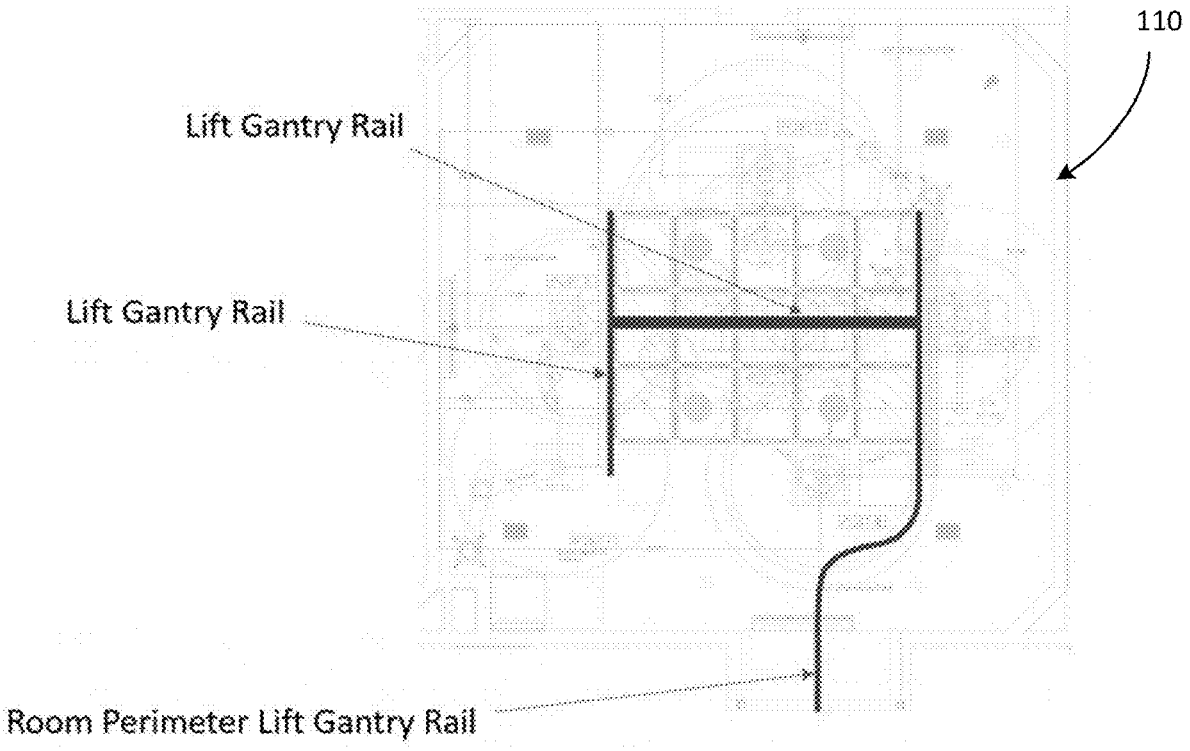
FIG. 11 is another diagram of a modular patient lift system in connection with which various examples can be implemented.

FIGS. 10 and 11 illustrate a modular patient lift system 110 according to various examples of the present disclosure. The modular patient lift system 110 illustrated in FIGS. 10 and 11 is for illustration only and should not be construed as limiting. Various examples of the modular patient lift system 110 can be used without departing from the scope of the present disclosure.

The modular patient lift system 110 includes a ceiling grid, a plurality of rails, a gantry, at least one motor, a and a patient lift and provides electronic movement of a patient lift along an x-axis, y-axis, and z-axis. To enable the electronic movement, the modular patient lift system 110 further includes one or more sensors 150 to provide electronic feedback regarding the position of the patient lift within the x, y, z-axis. The electronic feedback can include feedback for weight on the patient lift and g-forces of the patient lift. The feedback can be time-stamped to track the movement, location, weight, g-forces, and so forth of the patient lift over time.

The ceiling grid includes a plurality of tiles and at least one lighting element. Each tile of the plurality of tiles includes one or more vents configured to facilitate airflow into the central surgical suite where the modular patient lift system 110 is implemented. The airflow through the one or more vents can be deployed from the modular air handling device. The lighting element provides at least some of the light for the central surgical suite and can include, but is not limited to, an incandescent light, a light emitting diode (LED) light, and so forth. In some examples, the ceiling grid is integrated with the lighting and air distributing unit to distributes light and air throughout the medical suite.

The plurality of rails is supported by the ceiling grid. For example, a border provided on at least one side of the ceiling grid supports at least one of the plurality of rails. In some examples, the plurality of rails includes three rails. A first rail and a second rail are provided parallel to one another on opposite sides of the ceiling grid. The first rail and the second rail can be fixed to the ceiling grid. In other words, the first rail and the second rail are not configured to move about the ceiling grid. Each of the first rail and the second rail include a groove, or lift channel extrusion, on a face of the rail opposite the ceiling grid. For example, the groove is provided on a face provided downward opposite of the ceiling grid. However, this example should not be construed as limiting. The term downward is used in relation to the perspective shown in FIG. 10 and other examples are possible. As shown in FIG. 11, one or both of the first rail and the second rail can connect or extend a room perimeter lift gantry rail to move the gantry from a position outside the central surgical suite to a specific location within the central surgical suite, such as to transport a patient into the central surgical suite and to move the gantry from the specific location within the central surgical suite to a position outside the central surgical suite, such as to transport a patient out of the central surgical suite. A third rail is provided perpendicular to both the first rail and the second rail. The third rail is configured to move along the first rail and the second rail via the grooves provided in the first rail and the second rail. In some examples, the third rail is connected to the groove of the first rail via a first connection mechanism and connected to the groove of the second rail via a second connection mechanism. The first connection mechanism and the second connection mechanism are described in greater detail below. By connecting to the grooves of the first rail and the second rail, respectively, the third rail is configured to move back and forth in directions perpendicular to the first rail and the second rail, denoted as gantry travel Y in FIG. 10.

The gantry is provided on the third rail. More particularly, the gantry is connected to the groove of the third rail via a third connection mechanism. The third connection mechanism enables the gantry to move along the third rail, i.e., in a direction perpendicular to each of the first rail and the second rail, denoted as gantry travel X in FIG. 10. By combining the movement of the third rail in the gantry travel Y direction and the movement of the gantry along the third rail in the gantry travel X direction, the gantry can traverse an entirety of the area defined by the ceiling grid in addition to the area traversed by the room perimeter lift gantry rail.

The modular patient lift system 110 further includes the patient lift. The patient lift is connected to the gantry via a connection mechanism such as a cord, a synthetic rope, a winch, etc. and, accordingly, moves as the gantry is moved. The connection mechanism enables the patient lift to be raised, e.g., moved in a direction toward the ceiling grid, by drawing in the connection mechanism and can be lowered, e.g., moved in a direction away from the ceiling grid, by letting out the connection mechanism, denoted by lift travel Z in FIG. 10. When the lift travel Z direction is used in combination with the movement of the gantry and the gantry travel Y direction and the gantry travel X direction, the modular patient lift system 110 includes three-dimensional travel telemetry on an x-axis, a y-axis, and a z-axis.

The modular patient lift system 110 further includes at least one motor. In some examples, a first motor moves the third rail, a second motor moves the gantry along the third rail, and a third motor draws in and lets out the connection mechanism to raise and lower the patient lift. In some examples, the at least one motor is manually controlled by a user to move the patient lift. In some examples, the at least one motor is electronically controlled to move the patient lift. For example, the at least one motor can be electronically controlled by the electronic control module 130 to traverse the ceiling grid. In another example, a specific location including points on each of the x-axis, y-axis, and z-axis on the ceiling grid can be specified, either automatically or by a user input to the electronic control module, and the patient lift traverses to the specific location.

Figure 12:
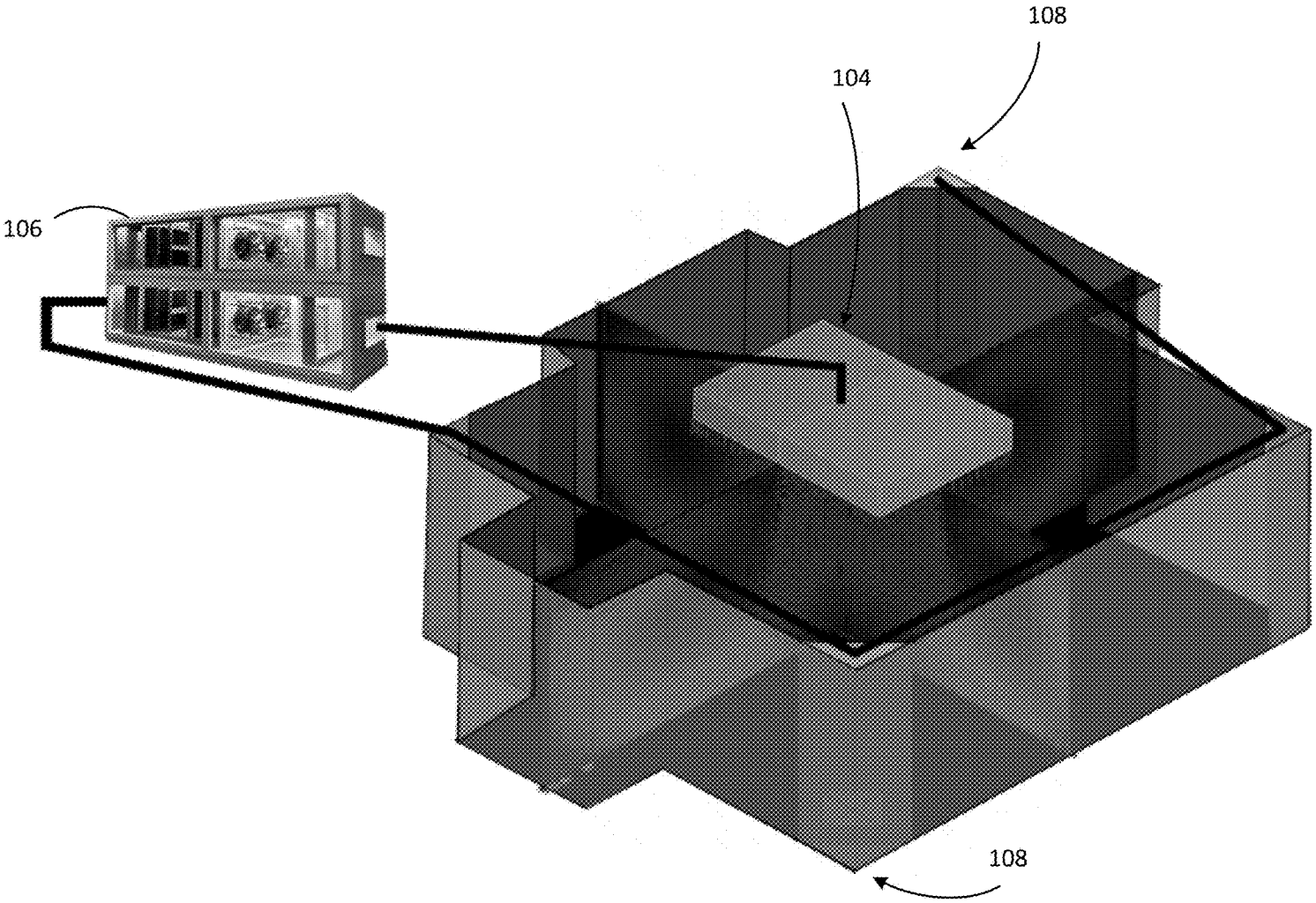
FIG. 12 is another diagram illustrating a central medical suite system according to various examples.

FIG. 12 illustrates a lighting and air distribution unit 104 according to various examples of the present disclosure. The lighting and air distribution unit 104 illustrated in FIG. 12 is for illustration only and should not be construed as limiting. Various examples of the lighting and air distribution unit 104 can be used without departing from the scope of the present disclosure.

The lighting and air distribution unit 104 is provided directly above a specific location where the patient 202 is placed for a medical evaluation, surgical procedure, and so forth. The lighting and air distribution unit 104 includes specialized ceiling tiles implemented in a grid. Each of the specialized ceiling tiles include a plurality of vents that can be opened, closed, or partially opened in order to control and facilitate the rate and volume of airflow into the central surgical suite. The lighting and air distribution unit 104 further includes lighting elements, such as incandescent lights, LED lights, and so forth, to provide at least some of the light to the central surgical suite. In some examples, the lighting and air distribution is integrated with the ceiling grid of the modular patient lift system 110 to facilitate the airflow and lighting to the central surgical suite, and particularly to the patient area of the central surgical suite, and to provide support for the plurality of rails of the modular patient lift system.

Figure 13:
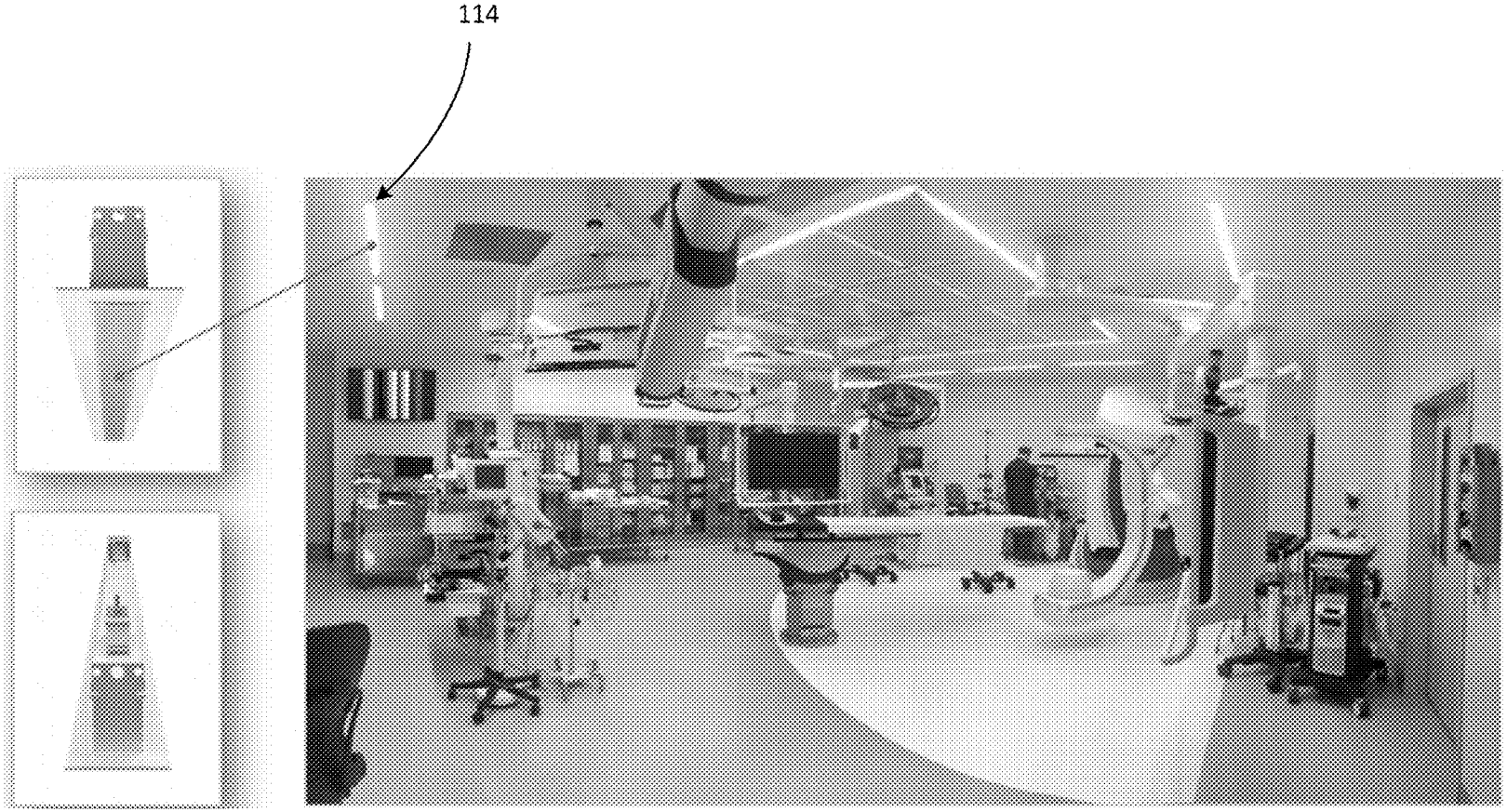
FIG. 13 is a diagram illustrating a central medical suite system having a room perimeter disinfecting system according to various examples.
Figure 14:
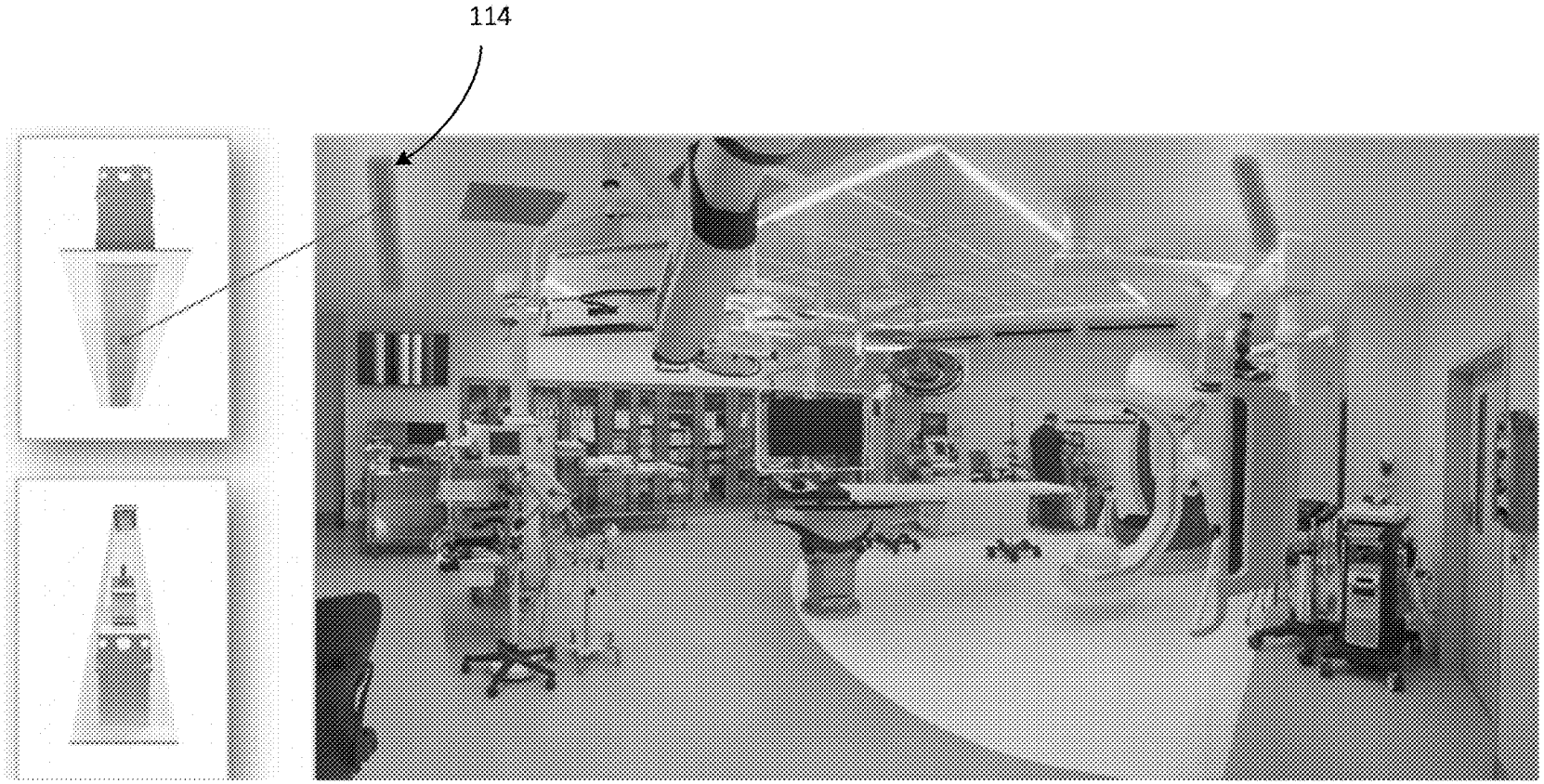
FIG. 14 is another diagram illustrating a central medical suite system having a room perimeter disinfecting system according to various examples.

FIGS. 13 and 14 illustrate a room perimeter disinfecting system 114 according to various examples of the present disclosure. The room perimeter disinfecting system 114 illustrated in FIGS. 13 and 14 is for illustration only and should not be construed as limiting. Various examples of the room perimeter disinfecting system 114 can be used without departing from the scope of the present disclosure.

As shown in FIGS. 13 and 14, the room perimeter disinfecting system 114 includes extrusions and lighting elements. The light is provided at particular wavelengths, or range of wavelengths, in order to disinfect the perimeter of the space (e.g., walls of a surgical room). For example, light can be provided at UV, Far UV, Indigo-clean (IC) 405 nm disinfection, VHP, and so forth wavelengths. In some examples, the light casts a color hue based on the wavelength of the light used. For example, IC 405 nm casts an indigo hue throughout the central surgical suite when the room perimeter disinfecting system is activated. The extrusions and lighting elements are provided to focus light at a particular angle based on the angle of the extrusions. For example, lighting elements can be set such that they are angled back toward a perimeter wall in order to reduce direct glare from the lens of the light that the users in the room would otherwise see if looking directly at the lights. In some examples, the intensity of the color hue cast by the lighting elements reflects the disinfecting dosage applied to the central surgical suite. For example, a higher intensity hue can reflect a higher dosage and a lower intensity can reflect a lower dosage.

The room perimeter disinfecting system 114 can be controlled automatically via the electronic control module 130 or via an input received by the electronic control module 130. For example, based on received sensor data for a specific location proximate to a lighting element of the room perimeter disinfecting system 114 indicating the presence of an infectant, the electronic control module 130 controls to activate, or increase the intensity of, the particular lighting element in order to disinfect the specific location or a particular zone that includes the specific location.

In some examples, the room perimeter disinfecting system 114 can be operable to cast light with and without activating a disinfectant. For example, FIG. 13 illustrates the room perimeter disinfecting system 114 without an activated disinfectant. While the disinfectant is not activated, the lighting element can be either activated or not activated. In contrast, FIG. 14 illustrates the room perimeter disinfecting system with an activated disinfectant. While the disinfectant is not activated, the lighting element can be either activated or not activated.

Figure 15:
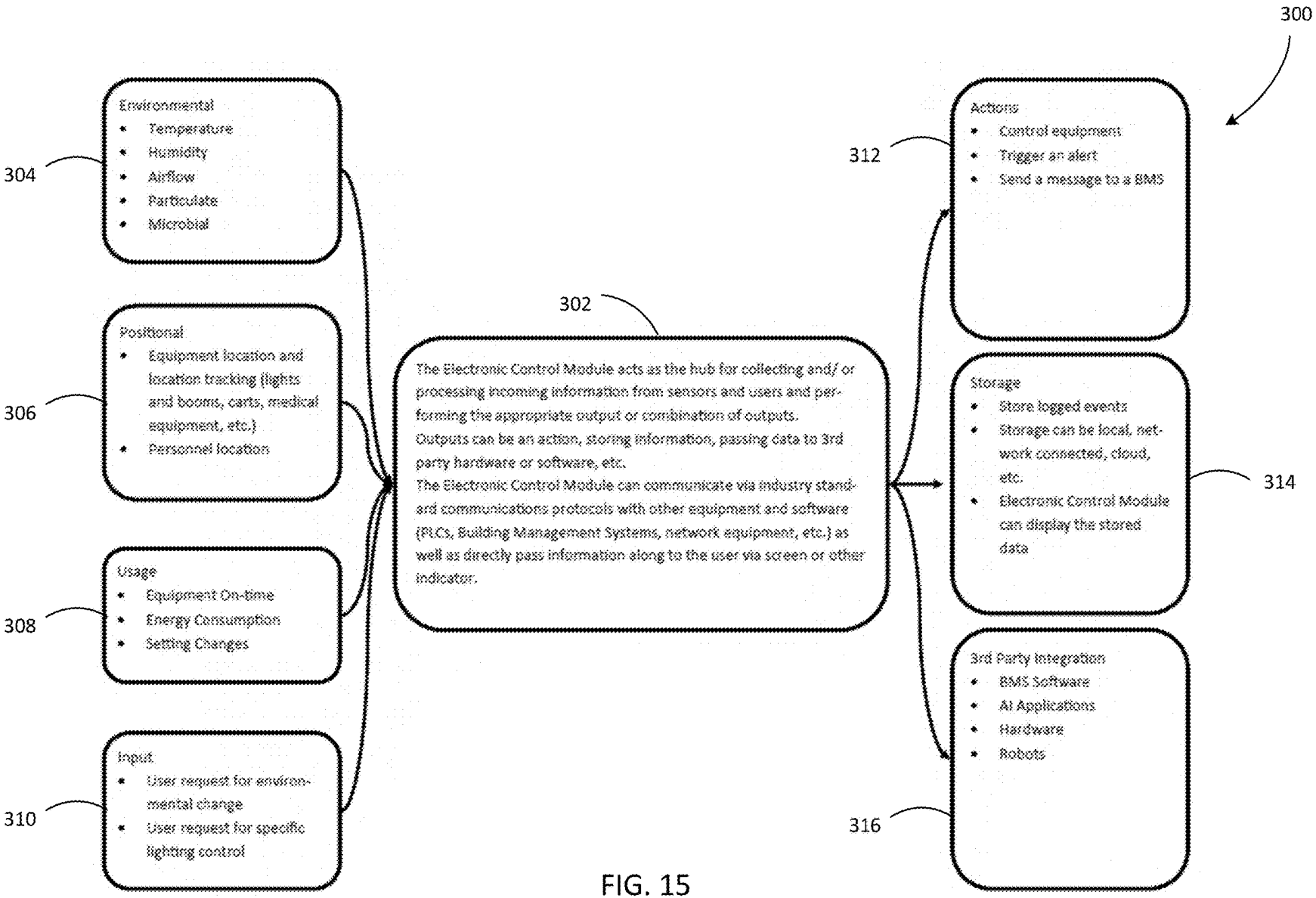
FIG. 15 is a functional block diagram illustrating a central medical suite system according to various examples.

FIG. 15 is a functional block diagram 300 illustrating a central suite medical system including the electronic control module 130 according to examples of the present disclosure. As shown in FIG. 15, the electronic control module 130 acts as the hub for collecting and/or processing incoming information from sensors and users and performing the appropriate output or combination of outputs at 302. Outputs can be, for example, an action, storing information, sending data to third party hardware or software, etc. The electronic control module 130 can communicate via industry standard communications protocols with other equipment and software (e.g., PLCs, Building Management Systems, network equipment, etc.), as well as directly communicate information along to the user via the display 134 or other indicator. For example, the electronic control module 130 collects and/or processes various types of incoming information, including, but not limited to environmental information, positional information, usage information, input information, action information, storage information, and third party integration information.

In some examples, the environmental information 304 includes one or more of temperature, humidity, airflow, particulate, and microbial information. The positional information 306 includes one or more of equipment information and location tracking (e.g., lights and booms, carts, medical information, etc.) and personnel location. The usage information 308 includes one or more of equipment on-time, energy consumption, and setting changes information. The input information 310 includes one or more of user requests for environmental change and user requests for specific lighting control. The action information 312 includes at least one of control equipment, triggered alerts, and messages sent to a BMS information. The storage information 314 includes one or more of storing logged events, local, network connected, cloud, etc. storage, and displaying the stored data on the electronic control module. Third party integration 316 includes one or more of BMS software, artificial intelligence (AI) applications, hardware, and robots. It should be noted that additional information can be provided and used in the various examples and above is merely for illustration as an example.

Figure 16:
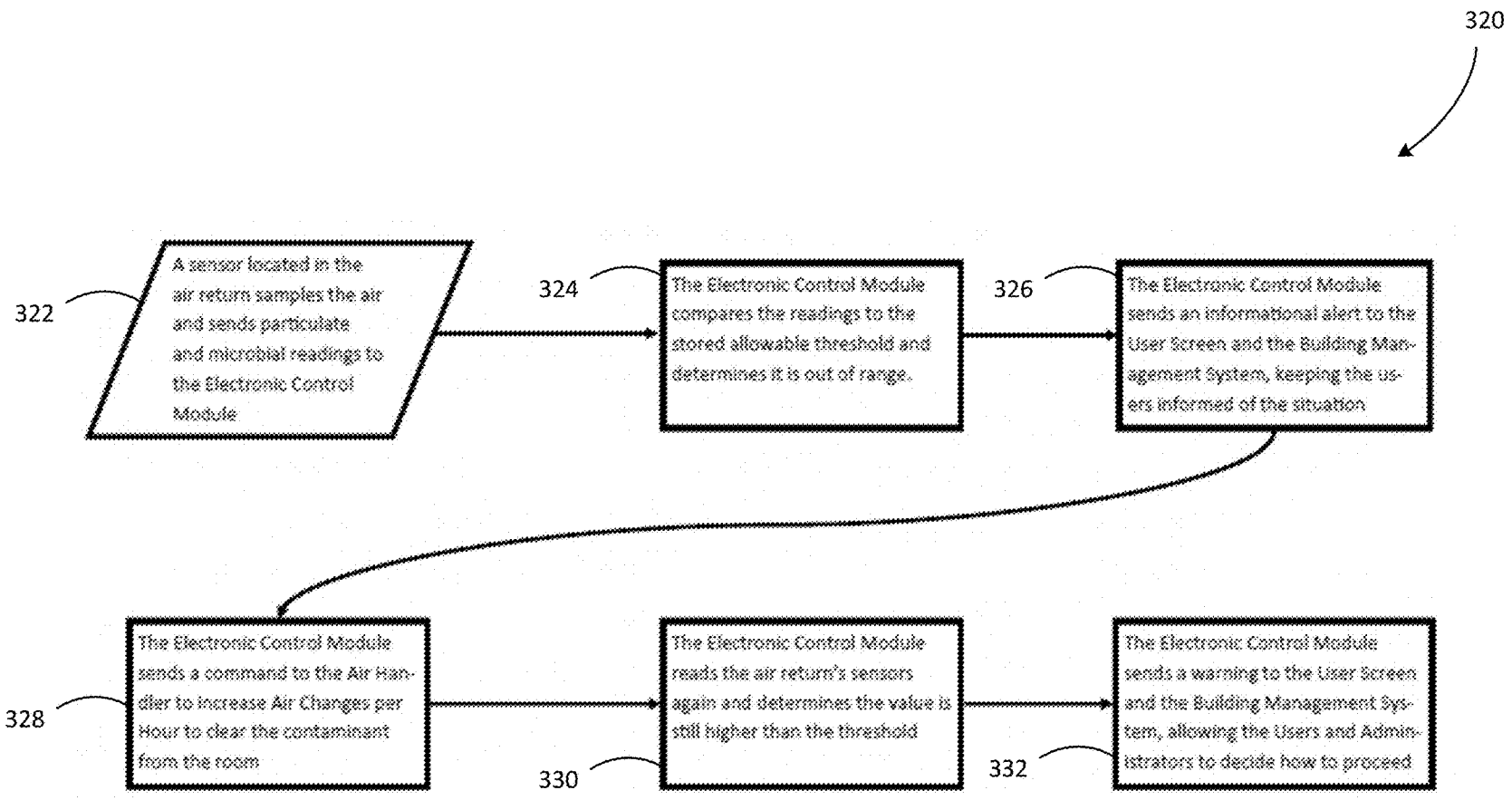
FIG. 16 illustrates an example of a method of central medical suite control implemented by an electronic control module according to various examples.

FIG. 16 illustrates an example of a computerized method 320 of central medical suite control implemented by the electronic control module 130 according to various examples of the present disclosure. For example, at 322, a sensor located in the air return samples the air and sends particulate and microbial readings to the electronic control module 130. The electronic control module 130 compares the readings to the stored allowable threshold and determines if it is out of the threshold range at 324. The electronic control module 130, at 326, sends an informational alert to the user screen (e.g., display 134) and the building management system (BMS), keeping users informed of the situation. The electronic control module 130 sends a command to the air handler to increase air changes per hour to clear the contaminant from the room at 328. The electronic control module 130 reads the air return's sensors again, after clearing the contaminant, and makes another determination regarding the contaminant and its comparison to the threshold at 330. For example, the electronic control module determines the value is still higher than the threshold. In this instance, the electronic control module sends a warning to the user screen and the BMS at 332, which allows users and administrators to decide or determine how to proceed.

Figure 17:
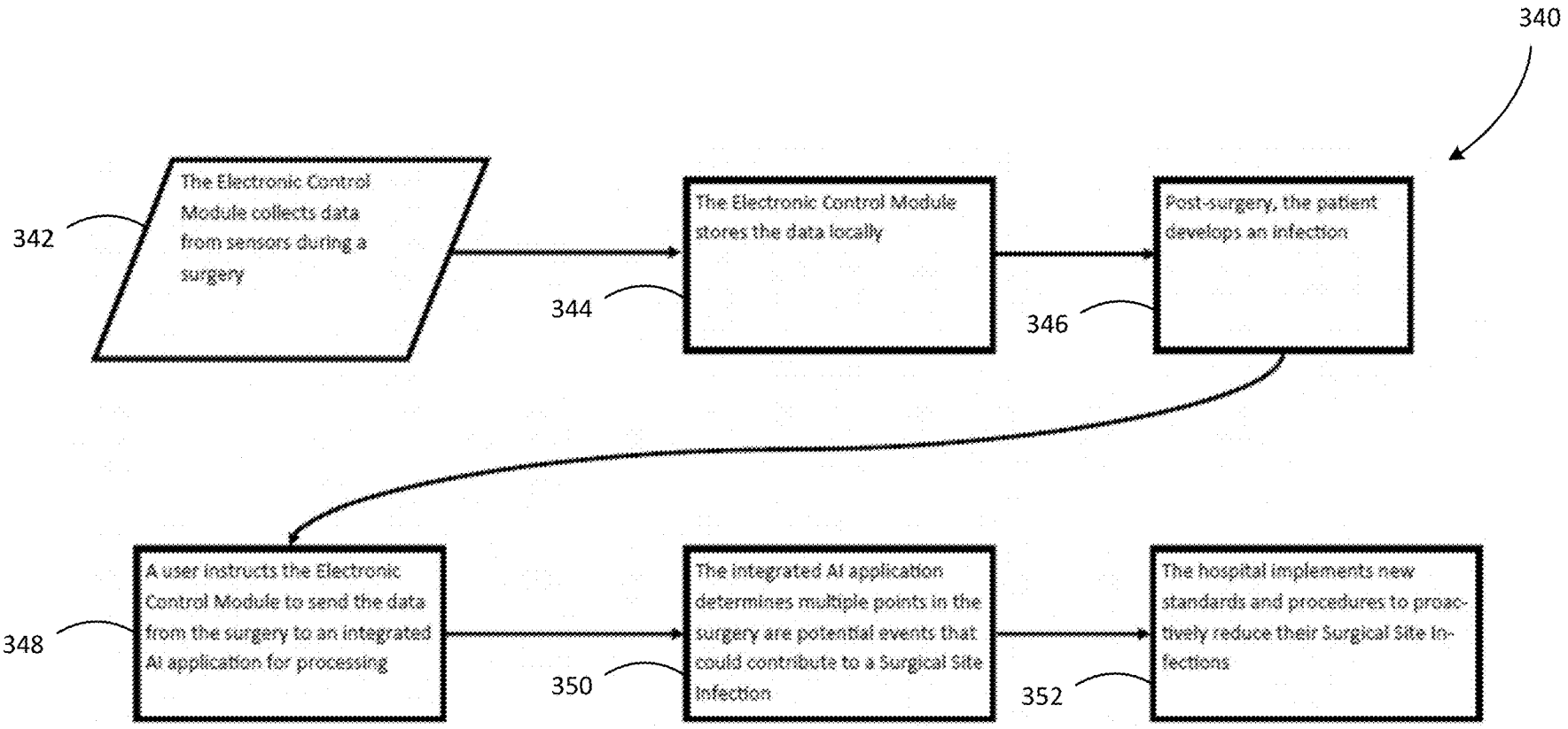
FIG. 17 illustrates another example of a method of central medical suite control implemented by an electronic control module according to various examples.

FIG. 17 illustrates an example of another computerized method 340 of central medical suite control implemented by the electronic control module 130 according to various examples of the present disclosure. For example, the electronic control module 130 collects data from various sensors during a surgery at 342 as described herein. The electronic control module 130 stores the data locally at 344. At some time after the conclusion of the surgery at 346, the patient develops an infection. The electronic control module 130 is instructed, such as by a user, to send the data from the surgery to an integrated AI application for processing at 348. The integrated AI application determines one or more points in the surgery are potential events that could contribute to a surgical suite infection at 350. The hospital implements new standards and procedures to proactively reduce their surgical site infections at 352.

Figure 18:
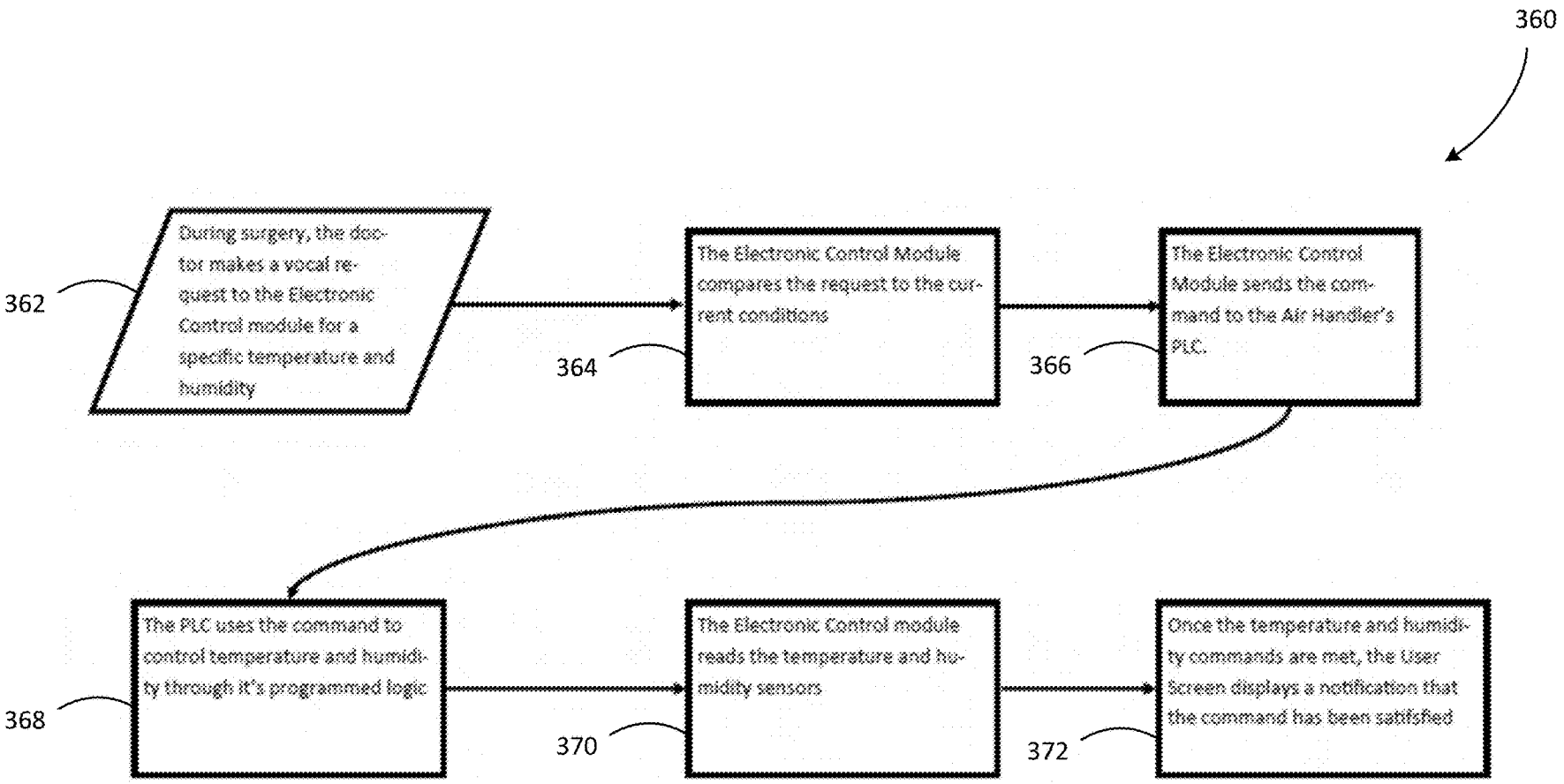
FIG. 18 illustrates another example of a method of central medical suite control implemented by an electronic control module according to various examples.

FIG. 18 illustrates another computerized method 360 of central medical suite control implemented by the electronic control module 130 according to various examples of the present disclosure. For example, during surgery, a doctor makes a vocal, i.e., verbal, request to the electronic control module 130 for a specific temperature and humidity of the air in the central medical suite at 362. The electronic control module 130 compares the request to the current conditions at 364 and sends a command to the PLC of the air handler at 366. The PLC utilizes the command to control the temperature and humidity through the programmed logic, such as via machine learning, at 368. The electronic control module 130 reads the temperature and humidity sensors at 370. Once the temperature and humidity commands are met, the user screen displays a notification that the command has been satisfied at 372.

It should be appreciated that the examples presented in FIGS. 16-18 are for illustration only and should not be construed as limiting. The electronic control module 130 can control the central medical suite system 100 based on various sensor data as described herein and for different conditions, configurations, etc. That is, the electronic control module 130 of the present disclosure is operable and/or configurable to be communicatively coupled to the devices described therein, receive feedback, and control operations thereof.

Figure 19:
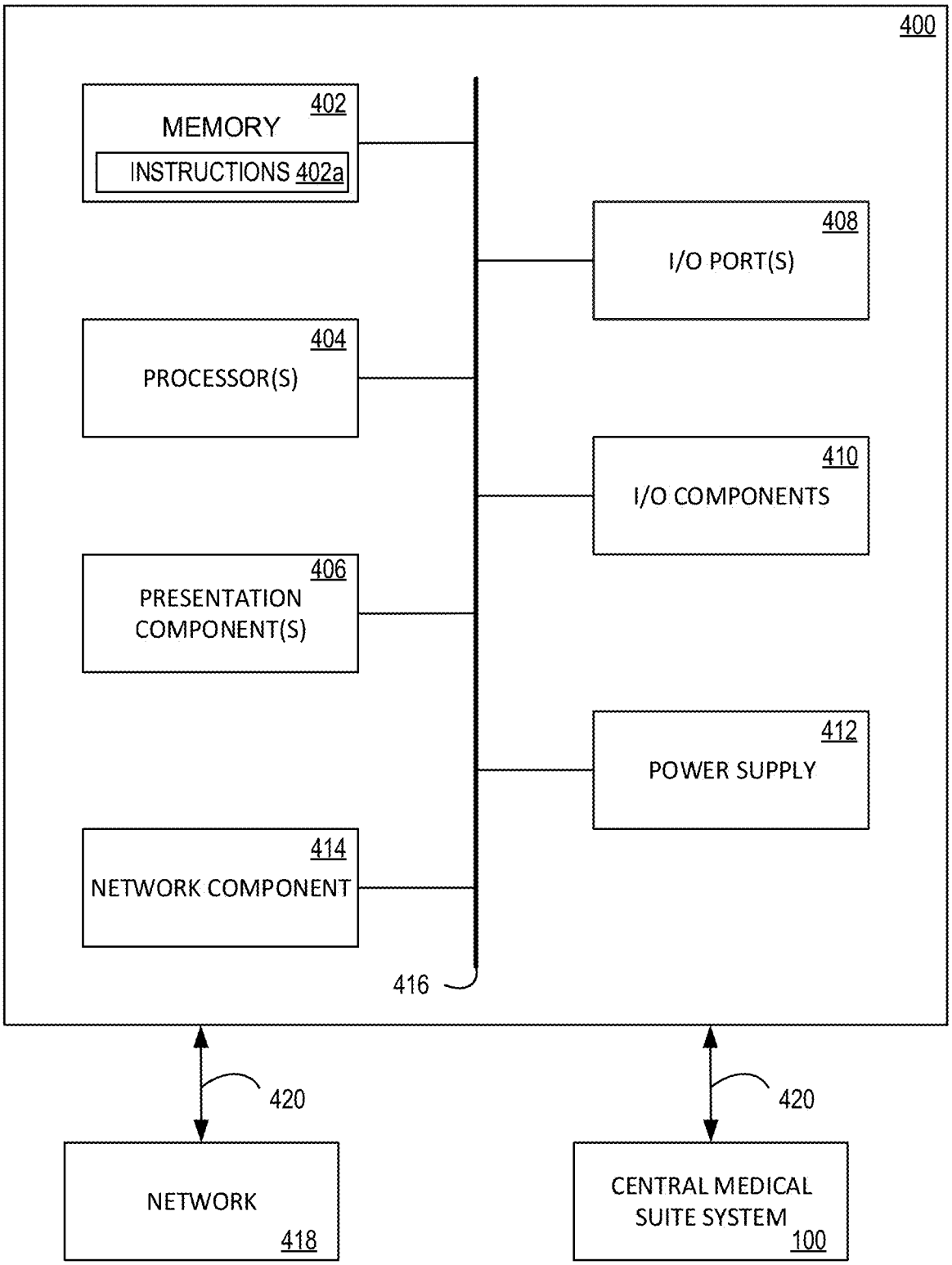
FIG. 19 is a block diagram of a computing environment suitable for implementing various examples.

With reference now to FIG. 19, a block diagram of a computing device 400 suitable for implementing various aspects of the disclosure as described (e.g., operations or functions to control the central medical suite system 100). FIG. 19 and the following discussion provide a brief, general description of a computing environment in/on which one or more or the implementations of one or more of the methods and/or system set forth herein may be implemented. The operating environment of FIG. 19 is merely an example of a suitable operating environment and is not intended to suggest any limitation as to the scope of use or functionality of the operating environment. Example computing devices include, but are not limited to, personal computers, server computers, hand-held or laptop devices, mobile devices (such as mobile phones, mobile consoles, tablets, media players, and the like), multiprocessor systems, consumer electronics, mini computers, mainframe computers, distributed computing environments that include any of the above systems or devices, and the like.

Although not required, implementations are described in the general context of "computer readable instructions" executed by one or more computing devices. Computer readable instructions may be distributed via computer readable media (discussed below). Computer readable instructions may be implemented as program modules, such as functions, objects, Application Programming Interfaces (APIs), data structures, and the like, that perform particular tasks or implement particular abstract data types. Typically, the functionality of the computer readable instructions may be combined or distributed as desired in various environments.

In some examples, the computing device 400 includes a memory 402, one or more processors 404, and one or more presentation components 406. The disclosed examples associated with the computing device 400 are practiced by a variety of computing devices, including personal computers, laptops, smart phones, mobile tablets, hand-held devices, consumer electronics, specialty computing devices, etc. Distinction is not made between such categories as "workstation," "server," "laptop," "hand-held device," etc., as all are contemplated within the scope of FIG. 19 and the references herein to a "computing device." The disclosed examples are also practiced in distributed computing environments, where tasks are performed by remote-processing devices that are linked through a communications network. Further, while the computing device 400 is depicted as a single device, in one example, multiple computing devices work together and share the depicted device resources. For instance, in one example, the memory 402 is distributed across multiple devices, the processor(s) 404 provided are housed on different devices, and so on.

In one example, the memory 402 includes any of the computer-readable media discussed herein. In one example, the memory 402 is used to store and access instructions 402*a* configured to carry out the various operations disclosed herein. In some examples, the memory 402 includes computer storage media in the form of volatile and/or nonvolatile memory, removable or non-removable memory, data disks in virtual environments, or a combination thereof. In one example, the processor(s) 404 includes any quantity of processing units that read data from various entities, such as the memory 402 or input/output (I/O) components 410. Specifically, the processor(s) 404 are programmed to execute computer-executable instructions for implementing aspects of the disclosure. In one example, the instructions 402*a* are performed by the processor 404, by multiple processors within the computing device 400, or by a processor external to the computing device 400. In some examples, the processor(s) 404 are programmed to execute instructions such as those illustrated in the flow charts discussed herein and depicted in the accompanying drawings.

In other implementations, the computing device 400 may include additional features and/or functionality. For example, the computing device 400 may also include additional storage (e.g., removable and/or non-removable) including, but not limited to, magnetic storage, optical storage, and the like. Such additional storage is illustrated in FIG. 19 by the memory 402. In one implementation, computer readable instructions to implement one or more implementations provided herein may be in the memory 402 as described herein. The memory 402 may also store other computer readable instructions to implement an operating system, an application program and the like. Computer readable instructions may be loaded in the memory 402 for execution by the processor(s) 404, for example.

The presentation component(s) 406 present data indications to an operator or to another device. In one example, the presentation components 406 include a display device, speaker, printing component, vibrating component, etc. One skilled in the art will understand and appreciate that computer data is presented in a number of ways, such as visually in a graphical user interface (GUI), audibly through speakers, wirelessly between the computing device 400, across a wired connection, or in other ways. In one example, the presentation component(s) 406 are not used when processes and operations are sufficiently automated that a need for human interaction is lessened or not needed. I/O ports 408 allow the computing device 400 to be logically coupled to other devices including the I/O components 410, some of which is built in. Implementations of the I/O components 410 include, for example but without limitation, a microphone, keyboard, mouse, joystick, pen, game pad, satellite dish, scanner, printer, wireless device, camera, etc.

The computing device 400 includes a bus 416 that directly or indirectly couples the following devices: the memory 402, the one or more processors 404, the one or more presentation components 406, the input/output (I/O) ports 408, the I/O components 410, a power supply 412, and a network component 414. The computing device 400 should not be interpreted as having any dependency or requirement related to any single component or combination of components illustrated therein. The bus 416 represents one or more busses (such as an address bus, data bus, or a combination thereof). Although the various blocks of FIG. 19 are shown with lines for the sake of clarity, some implementations blur functionality over various different components described herein.

The components of the computing device 400 may be connected by various interconnects. Such interconnects may include a Peripheral Component Interconnect (PCI), such as PCI Express, a Universal Serial Bus (USB), firewire (IEEE 1394), an optical bus structure, and the like. In another implementation, components of the computing device 400 may be interconnected by a network. For example, the memory 602 may be comprised of multiple physical memory units located in different physical locations interconnected by a network.

In some examples, the computing device 600 is communicatively coupled to a network 618 using the network component 414. In some examples, the network component 414 includes a network interface card and/or computer-executable instructions (e.g., a driver) for operating the network interface card. In one example, communication between the computing device 400 and other devices occurs using any protocol or mechanism over a wired or wireless connection 420. In some examples, the network component 414 is operable to communicate data over public, private, or hybrid (public and private) connections using a transfer protocol, between devices wirelessly using short range communication technologies (e.g., near-field communication (NFC), Bluetooth® branded communications, or the like), or a combination thereof.

The connection 420 may include, but is not limited to, a modem, a Network Interface Card (NIC), an integrated network interface, a radio frequency transmitter/receiver, an infrared port, a USB connection or other interfaces for connecting the computing device 400 to other computing devices. The connection 420 may transmit and/or receive communication media. In some examples, the connection 420 allows communication with the modular patient lift system 110 to allow, for example, for adjustment of the operation thereof.

Although described in connection with the computing device 400, examples of the disclosure are capable of implementation with numerous other general-purpose or special-purpose computing system environments, configurations, or devices. Implementations of well-known computing systems, environments, and/or configurations that are suitable for use with aspects of the disclosure include, but are not limited to, smart phones, mobile tablets, mobile computing devices, personal computers, server computers, hand-held or laptop devices, multiprocessor systems, gaming consoles, microprocessor-based systems, set top boxes, programmable consumer electronics, mobile telephones, mobile computing and/or communication devices in wearable or accessory form factors (e.g., watches, glasses, headsets, or earphones), network PCs, minicomputers, mainframe computers, distributed computing environments that include any of the above systems or devices, VR devices, holographic device, and the like. Such systems or devices accept input from the user in any way, including from input devices such as a keyboard or pointing device, via gesture input, proximity input (such as by hovering), and/or via voice input.

Implementations of the disclosure, such as controllers or monitors, are described in the general context of computer-executable instructions, such as program modules, executed by one or more computers or other devices in software, firmware, hardware, or a combination thereof. In one example, the computer-executable instructions are organized into one or more computer-executable components or modules. Generally, program modules include, but are not limited to, routines, programs, objects, components, and data structures that perform particular tasks or implement particular abstract data types. In one example, aspects of the disclosure are implemented with any number and organization of such components or modules. For example, aspects of the disclosure are not limited to the specific computer-executable instructions or the specific components or modules illustrated in the figures and described herein. Other examples of the disclosure include different computer-executable instructions or components having more or less functionality than illustrated and described herein. In implementations involving a general-purpose computer, aspects of the disclosure transform the general-purpose computer into a special-purpose computing device when configured to execute the instructions described herein.

By way of example and not limitation, computer readable media comprises computer storage media and communication media. Computer storage media include volatile and nonvolatile, removable, and non-removable memory implemented in any method or technology for storage of information such as computer readable instructions, data structures, program modules, or the like. Computer storage media are tangible and mutually exclusive to communication media. Computer storage media are implemented in hardware and exclude carrier waves and propagated signals. Computer storage media for purposes of this disclosure are not signals per se. In one example, computer storage media include hard disks, flash drives, solid-state memory, phase change random-access memory (PRAM), static random-access memory (SRAM), dynamic random-access memory (DRAM), other types of random-access memory (RAM), read-only memory (ROM), electrically erasable programmable read-only memory (EEPROM), flash memory or other memory technology, compact disk read-only memory (CD-ROM), digital versatile disks (DVD) or other optical storage, magnetic cassettes, magnetic tape, magnetic disk storage or other magnetic storage devices, or any other non-transmission medium used to store information for access by a computing device. In contrast, communication media typically embody computer readable instructions, data structures, program modules, or the like in a modulated data signal such as a carrier wave or other transport mechanism and include any information delivery media.

While various spatial and directional terms, including but not limited to top, bottom, lower, mid, lateral, horizontal, vertical, front and the like are used to describe the present disclosure, it is understood that such terms are merely used with respect to the orientations shown in the drawings. The orientations can be inverted, rotated, or otherwise changed, such that an upper portion is a lower portion, and vice versa, horizontal becomes vertical, and the like.

The word "exemplary" is used herein to mean serving as an example, instance or illustration. Any aspect or design described herein as "exemplary" is not necessarily to be construed as advantageous over other aspects or designs. Rather, use of the word exemplary is intended to present concepts in a concrete fashion. As used in this application, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Further, at least one of A and B and/or the like generally means A or B or both A and B. In addition, the articles "a" and "an" as used in this application and the appended claims may generally be construed to mean "one or more" unless specified otherwise or clear from context to be directed to a singular form.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims. Of course, those skilled in the art will recognize many modifications may be made to this configuration without departing from the scope or spirit of the claimed subject matter.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

Various operations of implementations are provided herein. In one implementation, one or more of the operations described may constitute computer readable instructions stored on one or more computer readable media, which if executed by a computing device, will cause the computing device to perform the operations described. The order in which some or all of the operations are described should not be construed as to imply that these operations are necessarily order dependent. Alternative ordering will be appreciated by one skilled in the art having the benefit of this description. Further, it will be understood that not all operations are necessarily present in each implementation provided herein.

Any range or value given herein can be extended or altered without losing the effect sought, as will be apparent to the skilled person.

Also, although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component which performs the specified function of the described component (e.g., that is functionally equivalent), even though not structurally equivalent to the disclosed structure which performs the function in the herein illustrated exemplary implementations of the disclosure.

Although examples described herein are described in connection with a particular air handling arrangement and environment, the present disclosure can be implemented in different arrangements and in different environments. For example, the present disclosure is implementable in any application or environment in which air flow control is desired.

As used in this application, the terms "component," "module," "system," "interface," and the like are generally intended to refer to a computer-related entity, either hardware, a combination of hardware and software, software, or software in execution. For example, a component may be, but is not limited to being, a process running on a processor, a processor, an object, an executable, a thread of execution, a program and/or a computer. By way of illustration, both an application running on a controller and the controller can be a component. One or more components may reside within a process and/or thread of execution and a component may be localized on one computer and/or distributed between two or more computers.

Furthermore, the claimed subject matter may be implemented as a method, apparatus or article of manufacture using standard programming and/or engineering techniques to produce software, firmware, hardware or any combination thereof to control a computer to implement the disclosed subject matter. The term "article of manufacture" as used herein is intended to encompass a computer program accessible from any computer-readable device, carrier or media. Of course, those skilled in the art will recognize many modifications may be made to this configuration without departing from the scope or spirit of the claimed subject matter.

In addition, while a particular feature of the disclosure may have been disclosed with respect to only one of several implementations, such feature may be combined with one or more other features of the other implementations as may be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

The implementations have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

What is claimed is:

1. A central medical suite system, comprising:

a modular air handling device configured to distribute airflow throughout the central medical suite system;

at least one of:

a modular air return device;

a modular patient lift system;

a lighting and air distributing unit;

a room perimeter disinfecting system;

an electronic control module configured to control the airflow from the modular air handling device and control one or more environmental remediation devices provided on or in at least one of the modular air handling device, the modular air return device, the modular patient lift system, the lighting and air distributing unit, and the room perimeter disinfecting system; and one or more sensors provided on the modular air handling device, the modular air return device, the modular patient lift system, the lighting and air distributing unit, and the room perimeter disinfecting system, wherein the one or more sensors are configured to transmit data corresponding to air quality within a medical room, wherein the electronic control module controls the one or more environmental remediation devices based on data received from the one or more sensors, and wherein controlling the one or more environmental remediation devices comprises generating one or more adjustments to affect the air quality.

2. The central medical suite system of claim 1, wherein the electronic control module comprises a display for displaying a representation of the data received from the one or more sensors, and the electronic control module is configured to receive a user input after displaying the representation.

3. The central medical suite system of claim 1, wherein the data received from the one or more sensors comprises at least one of temperature, humidity, airflow, particulate, and microbial information.

4. The central medical suite system of claim 1, wherein the data received from the one or more sensors comprises environmental data, positional data and usage data.

5. The central medical suite system of claim 4, wherein the electronic control module is further configured to receive user input data, actions data, storage data, and third party integration data, and generate one or more control signals for at least one of the modular air return device, the modular patient lift system, the lighting and air distributing unit, and the room perimeter disinfecting system.

6. The central medical suite system of claim 1, wherein the electronic control module is configured to control the airflow from the modular air handling device and control the one or more environmental remediation devices using an integrated artificial intelligence application.

7. The central medical suite system of claim 1, wherein the electronic control module is configured to control the airflow from the modular air handling device and control the one or more environmental remediation devices during a surgery of a patient.

8. The central medical suite system of claim 1, wherein the electronic control module is configured to generate a warning in response to the data received from the one or more sensors exceeding a defined threshold.

9. The central medical suite system of claim 1, wherein the electronic control module is configured to control the airflow from the modular air handling device and control the one or more environmental remediation devices based additionally at least in part on a user input.

10. The central medical suite system of claim 1, wherein the electronic control module is configured to control the airflow from the modular air handling device and control the one or more environmental remediation devices using a closed loop contamination control.

* * * * *